US009207018B2

(12) United States Patent
Jarvis

(10) Patent No.: US 9,207,018 B2
(45) Date of Patent: Dec. 8, 2015

(54) SUB-WET BULB EVAPORATIVE CHILLER SYSTEM WITH MULTIPLE INTEGRATED SUBUNITS OR CHILLERS

(71) Applicant: NEXAJOULE, INC., Boulder, CO (US)

(72) Inventor: Eric Edward Jarvis, Boulder, CO (US)

(73) Assignee: NEXAJOULE, INC., Boulder, CO (US)

( * ) Notice: Subject to any disclaimer, the term of this patent is extended or adjusted under 35 U.S.C. 154(b) by 223 days.

(21) Appl. No.: 13/916,677

(22) Filed: Jun. 13, 2013

(65) Prior Publication Data

US 2013/0333407 A1 Dec. 19, 2013

Related U.S. Application Data

(60) Provisional application No. 61/689,951, filed on Jun. 15, 2012.

(51) Int. Cl.

| | |
|---|---|
| ***F28C 3/08*** | (2006.01) |
| ***F28D 7/16*** | (2006.01) |
| ***F28D 9/00*** | (2006.01) |
| ***F28D 1/02*** | (2006.01) |

(52) U.S. Cl.

CPC . *F28C 3/08* (2013.01); *F28D 1/024* (2013.01); *F28D 7/16* (2013.01); *F28D 9/00* (2013.01)

(58) Field of Classification Search

CPC ..... F28C 3/08; F28C 3/02; F28C 3/14; F28D 7/16; F28D 9/00; F28D 1/024; F28D 7/1607

USPC ..... 62/314, 310, 259.4, 304, 271, 92, 93

See application file for complete search history.

(56) References Cited

U.S. PATENT DOCUMENTS

| | | | | |
|---|---|---|---|---|
| 2,270,810 | A | 1/1942 | Genaro | |
| 2,545,644 | A | 3/1951 | Benton et al. | |
| 4,026,760 | A * | 5/1977 | Connally | 159/48.2 |
| 4,380,910 | A | 4/1983 | Hood et al. | |
| 4,687,546 | A * | 8/1987 | Willis | 159/2.1 |
| 4,952,283 | A | 8/1990 | Besik | |
| 4,982,575 | A | 1/1991 | Besik | |
| 5,076,065 | A * | 12/1991 | Brogan | 62/91 |
| 5,435,382 | A | 7/1995 | Carter | |
| 5,661,983 | A * | 9/1997 | Groten et al. | 62/271 |
| 5,692,384 | A | 12/1997 | Layton | |
| 5,746,650 | A | 5/1998 | Johnson et al. | |
| 5,979,172 | A | 11/1999 | Teller | |
| 6,044,640 | A | 4/2000 | Guimaraes | |
| 6,178,762 | B1 * | 1/2001 | Flax | 62/271 |

(Continued)

*Primary Examiner* — Mohammad M Ali

(74) *Attorney, Agent, or Firm* — Marsh Fischmann & Breyfogle LLP; Kent A. Lembke

(57) ABSTRACT

A cooling system integrating a plurality of evaporative chillers, which each cool water to below ambient wet bulb temperature. In an air-to-air heat exchanger of each chiller, the incoming airstream used to evaporate water from the water stream is first cooled indirectly using the cooled air that is exhausted from a saturator of an adjacent chiller or subunit. By pre-chilling the air without adding moisture, each of the chillers of the cooling system is able to achieve water temperatures below the ambient wet bulb temperature. The system integrates or "daisy chains" multiple sub-wet bulb evaporative chillers or subunits such that the cool air output from one subunit is used to pre-cool the incoming air of another neighboring unit. To this end, adjacent units have their heat exchangers fluidically connected together (e.g., air flow output from each saturator is passed as cool return air through channels of an adjacent heat exchanger).

18 Claims, 13 Drawing Sheets

(56) References Cited

U.S. PATENT DOCUMENTS

| | | | | |
|---|---|---|---|---|
| 6,282,915 | B1 * | 9/2001 | Egbert | 62/314 |
| 6,319,599 | B1 | 11/2001 | Buckley et al. | |
| 6,442,942 | B1 * | 9/2002 | Kopko | 60/773 |
| 6,497,107 | B2 | 12/2002 | Maisotsenko et al. | |
| 6,502,807 | B1 | 1/2003 | Assaf et al. | |
| 6,562,754 | B1 * | 5/2003 | Inagaki et al. | 502/401 |
| 6,776,001 | B2 * | 8/2004 | Maisotsenko et al. | 62/315 |
| 6,935,132 | B1 * | 8/2005 | Urch | 62/324.1 |
| 6,938,434 | B1 | 9/2005 | Fair | |
| 7,093,452 | B2 * | 8/2006 | Chee et al. | 62/175 |
| 7,698,906 | B2 | 4/2010 | Jarvis | |
| 8,783,053 | B2 * | 7/2014 | McCann | 62/259.4 |
| 2001/0002620 | A1 * | 6/2001 | Carter et al. | 165/201 |
| 2003/0209017 | A1 | 11/2003 | Maisotsenko et al. | |
| 2004/0083698 | A1 | 5/2004 | Reneker et al. | |
| 2005/0279115 | A1 | 12/2005 | Lee et al. | |
| 2006/0168981 | A1 | 8/2006 | Mager et al. | |
| 2006/0197241 | A1 | 9/2006 | Brenneke et al. | |
| 2007/0151278 | A1 * | 7/2007 | Jarvis | 62/310 |
| 2007/0241468 | A1 * | 10/2007 | Kammerzell | 261/153 |
| 2008/0003940 | A1 * | 1/2008 | Haglid | 454/228 |
| 2009/0283245 | A1 * | 11/2009 | Hentschel et al. | 165/100 |
| 2010/0181062 | A1 * | 7/2010 | McCann | 165/287 |
| 2010/0186438 | A1 * | 7/2010 | Jarvis | 62/311 |
| 2010/0319370 | A1 * | 12/2010 | Kozubal et al. | 62/92 |
| 2011/0113798 | A1 * | 5/2011 | Pichai | 62/121 |
| 2011/0120685 | A1 * | 5/2011 | Van Heeswijk et al. | 165/170 |
| 2011/0120693 | A1 * | 5/2011 | Kammerzell et al. | 165/201 |
| 2011/0209580 | A1 * | 9/2011 | Rocha et al. | 75/383 |
| 2012/0118155 | A1 * | 5/2012 | Claridge et al. | 96/9 |

* cited by examiner

SUB-WET BULB EVAPORATIVE CHILLER SYSTEM WITH MULTIPLE INTEGRATED SUBUNITS OR CHILLERS

CROSS-REFERENCE TO RELATED APPLICATIONS

This application claims the benefit of U.S. Provisional Application No. 61/689,951, filed Jun. 15, 2012, which is incorporated herein by reference in its entirety.

BACKGROUND

1. Field of the Description

The present description relates to evaporative chillers and evaporative cooling systems, and more particularly, to an evaporative water chiller system or evaporative fluid cooling system adapted to make effective use of a plurality (or of multiple) subunits or chillers to enhance the results achieved by a single unit or chiller. Each subunit may be operable to lower the temperature of water or other liquid exiting the chiller or chiller system to below the ambient wet-bulb temperature, and the operation of each subunit may include pre-cooling the incoming air flow or airstream to a temperature below the ambient air temperature, such as by using the outgoing or exiting air flow or airstream.

2. Relevant Background

Today, a large fraction of the electrical energy used in the United States and elsewhere in the world is used for cooling interior spaces, such as inhabited areas of residential and commercial buildings, to desired or acceptable temperatures. In some geographic regions, cooling costs may be more than half of the annual energy cost for businesses and home owners. The electrical energy used for space cooling is not only costly but causes problems because it is concentrated into certain times of the day when highest temperatures are experienced, and this high demand can create high peaks in power demand that are difficult for power companies to satisfy. Hence, there is an ongoing need for reducing the amount of energy needed for cooling and for better distributing the demand to reduce the size of spikes or peaks in demand. Reducing demand for electricity is a vital and growing concern as the human population increases, as more and more countries become industrialized and more urban, as concerns heighten over global warming from fossil fuel combustion, and as the availability of fossil fuels dwindles and the associated prices rise. One way to control electricity or power consumption is to develop lower-energy, alternative cooling systems that have the potential to reduce overall and peak electricity usage.

However, it has proven difficult to design cooling systems and devices that can effectively compete with refrigerant-based air conditioning (A/C) systems to significantly reduce overall power consumption. Evaporative coolers are one approach, but a number of disadvantages have blocked widespread use of these cooling systems. Evaporative cooling involves evaporation of a liquid to cool an object or a liquid in contact with an airstream. When considering water evaporating into air, the web bulb temperature of the ambient air (as compared with the dry bulb temperature) is a standard measure for the potential for evaporative cooling systems, and the greater the difference between the wet bulb and dry bulb temperatures the greater the possible evaporative cooling effect. Evaporative cooling is a fairly common form of cooling for buildings for thermal comfort since it is relatively cheap and requires less energy than many other forms of cooling. However, evaporative cooling requires a water source as an evaporative and is presently only efficient when the relative humidity is low, which has restricted its use to geographic regions with dry climates.

Smaller scale evaporative coolers are often called swamp coolers, and the typical swamp cooler passes an air stream from outside of the building or interior space through the swamp cooler to contact water or other liquid in the cooler. The air is cooled by evaporation of the water, and the cooled air is directed by fans into the building or interior space. Traditional evaporative or swamp coolers have met with a fair degree of market acceptance because they work well in arid and semi-arid regions and are inexpensive to purchase and operate. While such coolers can often provide most or all of the cooling needed for a home or business, they suffer from several disadvantages. Swamp coolers are generally incompatible for integration with compressor-based A/C because they are "pass-through" systems in which conditioned air must be allowed to flow out of the building. They also require large air flow rates and may be noisy. Further, evaporative coolers in which the cooling air contacts the water may introduce mold and allergens into the interior of the building and often unacceptably raise the indoor humidity making it "muggy" in the building. Evaporative coolers also can require significant maintenance and often require winterization to avoid damage.

An alternative cooling system involves the use of an evaporative cooling system that functions by cooling a volume of liquid such as water by evaporating a portion of the cooling liquid in a stream of ambient or outdoor air. Such systems are referred to herein as "evaporative chillers." The cooled or chilled liquid can be circulated through piping of an air-to-water heat exchanger to cool the interior air blown or drawn through the exchanger. The air is cooled as heat is transferred to the water in the pipes and does not directly contact the water. The cooler air is returned to the interior spaces of the building. Evaporative chillers, which are also known as cooling towers, are more common in commercial buildings and can provide a large portion of the required cooling. Evaporative chillers are sometimes unable to lower the temperature of the water sufficiently to cool the interior space or building to an acceptable level, and, in these cases, conventional compressor and refrigerant-based air conditioning may be used to supplement the cooling achieved by evaporative cooling. However, this reduces the energy savings provided by use of the evaporative cooling system. When compared with swamp coolers and similar systems, evaporative chiller systems are compatible with compressor-based A/C units, do not introduce allergens or humidity to the cooling air (because there is no direct contact between indoor air and the chilled water), and do not require large air flow through the interior spaces of the building. In addition, evaporative chillers integrate well with typical HVAC practices in that the location of the chiller unit is flexible and existing ductwork can be utilized. Evaporative chillers are also compatible with radiant cooling technologies that are gaining acceptance in some areas. In addition, there are many other applications for chilled water from evaporative chillers or cooling towers such as removal of heat from the condenser side of heat pumps or to provide cooling for industrial processes.

Even in light of these advantages, traditional evaporative chillers or cooling towers have not been widely used for cooling in the residential market. Depending on the wet bulb temperature, evaporative chillers often will not be able to cool the flowing coolant or water to a low enough temperature to effectively cool a building or interior space. Evaporative chillers may be seen as an unnecessary expense or an expense that will require many years to recoup based on potential energy savings. The costs associated with an evaporative chiller may be particularly unpalatable if a backup A/C system is still required to handle higher loads or to cool on hotter days.

Thus, the ability of an evaporative chiller to more effectively lower the water temperature relative to the ambient wet bulb temperature is key to the success of such cooling systems, and there remains a need for cooling systems that are more energy efficient and preferably that more effectively implement evaporative cooling to cool buildings or interior spaces within a residence or commercial structure. Preferably, such cooling systems would include an evaporative chiller that is designed to provide improved levels of cooling (i.e., lower water temperatures) with low energy consumption. Reduced temperatures would enable stand-alone evaporative chiller-based cooling systems in some areas that otherwise would have required backup NC. In addition, temperature reductions for commercial buildings' chilled water systems would significantly increase system efficiencies by, for example, allowing heat pump equipment to operate at higher coefficients of performance. Therefore, an improved evaporative chiller would find applications in both residential and commercial settings.

SUMMARY

Briefly, a cooling system is provided that integrates a plurality of chillers or evaporative subunits in a unique manner to achieve cross-current flows of air and water in a configuration that provides staged cooling of the water. The cooling system may be used for applications such as space cooling in residences or commercial buildings. In each chiller or subunit of the integrated system or assembly, the water flows, through the "saturator" portion, downward under the force of gravity.

In an air-to-air heat exchanger of each chiller or subunit, the incoming airstream that is used to evaporate water from the water stream is first cooled indirectly using the cooled air that is exhausted from a saturator of an adjacent chiller or subunit. By pre-chilling the air without adding moisture, each of the chillers of the cooling system is able to achieve water temperatures below the wet bulb temperature and, theoretically, water temperatures at or near the dewpoint of the outside air. In a typical cooling system embodiment, each of the chillers provides a vertical cooling gradient both in the heat exchanger as well as in the saturator.

The cooling systems integrate or "daisy chain" multiple (e.g., two to four or more) sub-wet bulb evaporative chillers or evaporative cooling subunits such that the cool air output from one unit is used to pre-cool the incoming air of another neighboring unit. To this end, adjacent units have their heat exchangers fluidically connected together (e.g., air flow output from each saturator is passed as cool return air through channels of an adjacent heat exchanger with these channels in heat transfer contact with incoming ambient air). This design provides the potential for a very compact design with maximal heat and mass transfer area. In addition, the cooling systems are often configured to provide two or more compartments for water and air flow so as to take advantage of the non-uniformity of cross flow, plate-based heat exchangers. In conjunction with the gradient effect described herein for each chiller or subunit of the cooling system, the design of the cooling systems allows lower water temperatures to be achieved, such as temperatures approaching the ambient dewpoint.

More particularly, an evaporative chiller system or cooling system is provided that includes: a first evaporative chiller; a second evaporative chiller; a third evaporative chiller; and a fourth evaporative chiller. In the cooling system, the first, second, third, and fourth evaporative chillers are integrated (e.g., with proper ducting to fluidically interconnect adjacent chillers or subunits) to define a plurality of airstream flow paths extending through at least two of the evaporative chillers. Each of the airstream flow paths may be linear (or substantially straight or without bends of more than about 5 to 10 degrees). In a typical implementation of the cooling system, the heat exchangers are each configured as a cross-flow, horizontal-plate, air-to-air heat exchanger. In these or other implementations, the first, second, third, and fourth evaporative water chillers may each be designed as (or to function as) a sub-wet bulb evaporative chiller.

The cooling system may include an outer sump and an inner sump. Then, the water to be cooled is first distributed to flow in an outer portion of each of the saturators and is drained into an outer sump. The water is further pumped from the outer sump to be second distributed to flow in an inner portion of each of the saturators and is drained into an inner sump.

In the cooling system, a first ambient air stream is moved through a heat exchanger of the first evaporative chiller and directed through a saturator of the second evaporative chiller, and the first ambient air stream exhausted from the saturator of the second evaporative chiller is directed through a heat exchanger of the second evaporative chiller prior to being exhausted from the cooling system. Additionally, a second ambient air stream is moved through a heat exchanger of the second evaporative chiller and directed through a saturator of the third evaporative chiller, and the second ambient air stream exhausted from the saturator of the third evaporative chiller is directed through a heat exchanger of the third evaporative chiller prior to being exhausted from the cooling system. Yet further, a third ambient air stream is moved through a heat exchanger of the third evaporative chiller and directed through a saturator of the fourth evaporative chiller, and the third ambient air stream exhausted from the saturator of the fourth evaporative chiller is directed through a heat exchanger of the fourth evaporative chiller prior to being exhausted from the cooling system. Still further to complete the "daisy chain" configuration of the chillers/subunits, a fourth ambient air stream is moved through the heat exchanger of the fourth evaporative chiller and directed through a saturator of the first evaporative chiller, and the fourth ambient air stream exhausted from the saturator of the first evaporative chiller is directed through the heat exchanger of the first evaporative chiller prior to being exhausted from the cooling system.

DETAILED DESCRIPTION

Figure 1:
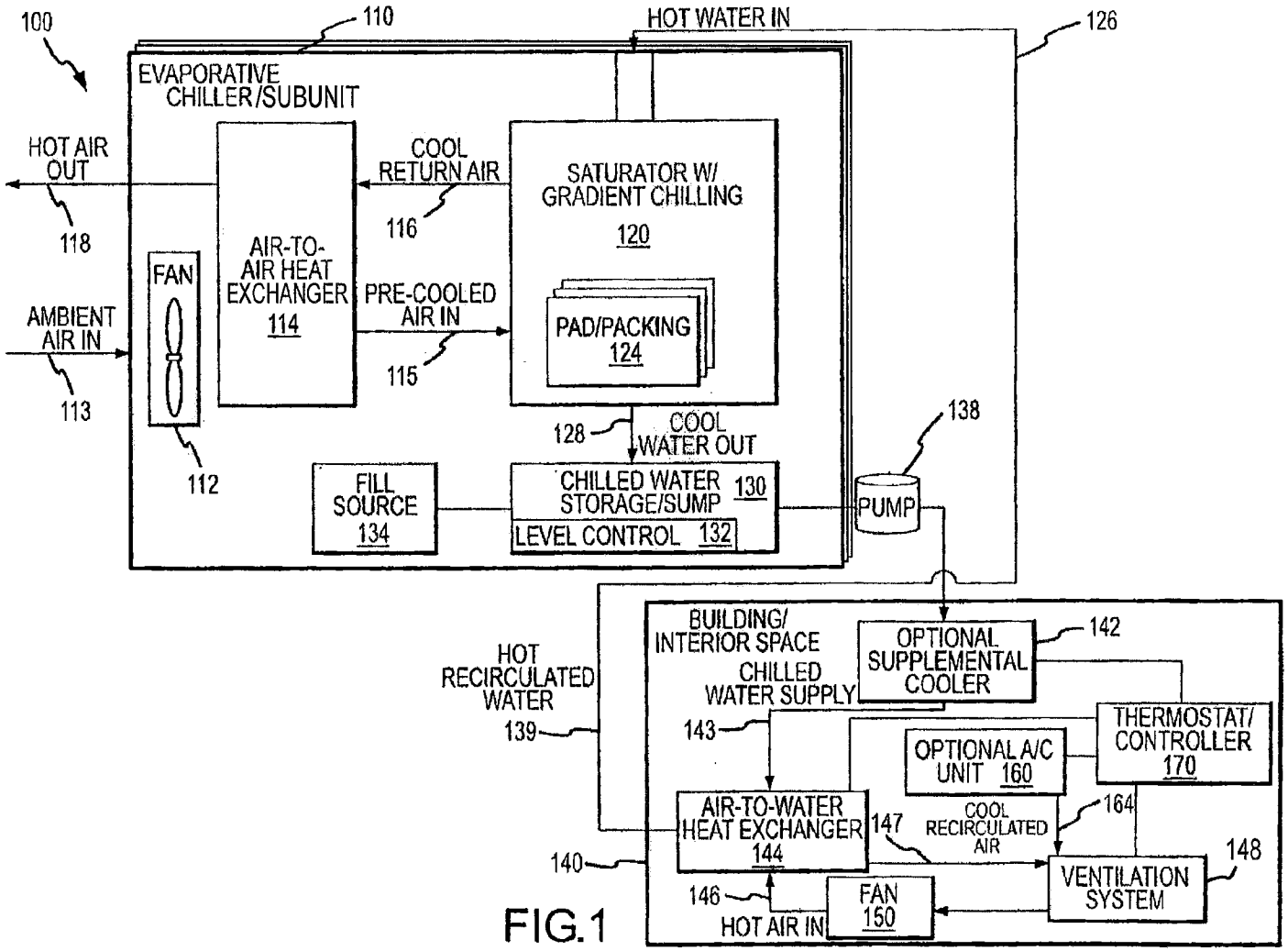
FIG. 1 is a functional block diagram of a cooling system including a plurality of (or multiple) sub-wet bulb evaporative chillers or "subunits" that are integrated in a manner according to the present description.

The present description is generally directed at cooling systems or assemblies made up of multiple (or a plurality of) evaporative chillers or subunits that are integrated in unique ways to provide residential and commercial cooling capacities that exceed that of a single one of such chillers or evaporative chiller subunits. Therefore, prior to turning to the systems and assemblies integrating multiple subunits or evaporative chillers, the design, use, and operation of exemplary evaporative chillers that may be used as a subunit are described in detail. Then, the description proceeds to describing problems with combining these subunits and how the systems/assemblies taught by the inventor address these problems.

The evaporative chillers or subunits of the present invention are unique for at least two reasons. First, the chillers are designed to pre-cool the incoming air flow from the ambient temperature to a lower temperature prior to its entering the saturator and contacting the liquid to be chilled (e.g., the liquid may be water in many embodiments but other liquids may be utilized to practice the invention). This pre-cooling phase is generally achieved with a heat exchanger in which the hot gas is the incoming or inlet ambient air (or other gas in some embodiments) and the cold gas is the outlet or return air that has passed through and been cooled in the saturator.

Second, the chillers or subunits are designed to provide gradient chilling in the saturator, e.g., the highest temperature water toward the top of the saturator is cooled by air at a first temperature and the coolest temperature water toward the bottom of the saturator is cooled by air at a second temperature, with the second temperature being significantly lower than the first temperature and water or liquid flowing between the top and bottom of the saturator or water column will generally decrease in temperature from the top to the bottom to provide a desired gradient (or, more accurately, the higher enthalpy water enters at the top and the lower enthalpy water exits at the bottom with an enthalpy gradient between). Generally, the cooling air is also directed transversely and, in many cases, orthogonally across the path of the flowing water in the saturator to establish a cross-flow pattern rather than a counter-current flow as is used in many conventional chillers.

In many versions of the chillers or subunits, saturator cross-flow and gradient chilling are provided. The water in the saturator moves vertically downward under the force of gravity while the air stream is moved by one or more fans or blowers horizontally through the saturator (e.g., in cross-flow or transverse direction relative to the water stream or water flow direction). This is unlike many cooling towers in which the water and air flows are directly opposite or counter-current. The cross-flow pattern allows chillers or subunits of the evaporative cooling systems or assemblies to establish and maintain a vertical temperature gradient (e.g., to provide gradient chilling). The water stream or inlet water enters the top of each of the saturators of a multiple subunit assembly at an elevated temperature because, for example, the water has gained enthalpy after passing through a heat exchanger in a residential or commercial building or interior space that is being cooled by use of the chillers (or a system including multiple chillers or subunits). As the water passes down through the saturator over packing and/or pads, the enthalpy of the water decreases as heat is given up as latent heat in the passing airstream through evaporative cooling (e.g., an enthalpy gradient exists in the water in the saturator that decreases from the top to the bottom of the saturator).

The air passing through the saturator is also cooled by the evaporative cooling in the saturator, and the air passing through the saturator near the bottom of the saturator is cooled to a lower temperature than the air passing through near the top of the saturator because of the range or gradient of the temperature and enthalpy of the water in the saturator (e.g., due to the higher temperature of the water near the inlet to the saturator as compared to the temperature of the water near the outlet of the saturator). The air being drawn into or blown into the chiller or incoming air is pre-cooled indirectly (or without direct contact) by the outgoing air (e.g., in a heat exchanger and, in some cases, in the saturator itself). In such a heat exchanger design the air mixes relatively little in the vertical direction or dimension. This lack of mixing is typically maintained for both the incoming air and the outgoing air, and it is used and maintained so that the warmest (or highest enthalpy) water and incoming/outgoing airstreams (i.e., after pre-cooling) are located at the top of the chiller and saturator while the coolest (or lowest enthalpy) water and incoming/outgoing airstreams are located at the bottom of the chiller and saturator. In this description, this variation of temperatures vertically in the chiller and saturator is labeled "gradient chilling" or "vertical chilling gradient" or the like.

Pre-cooling of the incoming air is important or at least typically desirable, and this is achieved generally with a heat exchanger that is placed between the inlet of the ambient air and the saturator (or is provided in part in the saturator in some cases such as a plate arrangement). Generally, the heat exchanger is an air-to-air configuration in which the incoming ambient air transfers some amount of heat to the outgoing air, but at least one embodiment involves using the air exiting the saturator to cool a different medium (such as a liquid flowing in piping or tubes or material in a cooling matrix) that is positioned in the path of the incoming air (e.g., upstream of the saturator air inlet). The heat exchange in air-to-air embodiments is typically achieved in a counter-current manner so as to maximize the efficiency and completeness of the heat transfer.

The chiller or subunit configurations may vary as is shown in the supporting figures and described herein, but the designs are all generally adapted to reduce the wet bulb temperature of the air being fed into the saturator when compared with the ambient air being blown or drawn through the chiller. As a result, all or most designs of the chillers or subunits described in the following paragraphs may be thought of as a sub-wet bulb temperature evaporative chiller. In addition to being able to produce chilled water at a temperature below the ambient wet bulb temperature, the chiller or subunit designs are typically selected to provide efficient heat exchange, to be relatively compact, and to be inexpensive to fabricate, install, and maintain.

FIG. 1 illustrates one embodiment of a cooling system 100 that may be used to cool or condition an interior space or building (residential or commercial) 140. The system 100 is shown to include a plurality of (or multiple) evaporative chillers 110, which are integrated together as described below. Each of the chillers or subunits 110 may be configured as described above as a sub-wet bulb temperature evaporative chiller. In this regard, the chiller 110 includes a fan or fans 112 for moving ambient air 113 into the chiller 110. The fan(s) 112 may be positioned as shown to blow or force the air 113 through the components of the chiller, or, in some cases, it may be positioned to draw the air 113 through the chiller 110 (e.g., be positioned at the outlet of the chiller 110) or be positioned within the chiller 110 (or fans may be positioned in any combination of these positions).

The chiller or subunit 110 includes a heat exchanger 114 and a saturator 120, with the heat exchanger 114 being positioned upstream of the saturator inlet. As a result, the ambient air 113 is cooled to produce pre-cooled air 115 that is fed to the inlet of the saturator 120. Generally, this "pre-cooling" is achieved by using the cool return air 116 exiting the outlet of the saturator 120 after passing over and/or through the pads/packing 124 of the saturator 120. Thus, the exiting air 116 is typically at a lower temperature than the ambient air 113 and the heat exchanger 114 makes use of this temperature differential to obtain efficient heat transfer. The exchanger 114 outputs the pre-cooled air 115 that has a lower temperature and lower wet bulb temperature than the ambient air 113 fed into the chiller 110 and outputs air 118 after it has passed through the heat exchanger 114. The heat exchanger 114 may take many forms to practice the system 100, with air-to-air heat exchangers being one useful example, e.g., a horizontal plate embodiment or the like.

Water to be cooled 126 (e.g., that has a raised enthalpy due to its use for cooling the building 140) is fed into a water inlet of the saturator 120. The inlet is generally at the top of the saturator 120, and the water 126 is allowed to gravity feed or drain over the pads/packing 124 where it is contacted by pre-cooled air 115 from the heat exchanger 114. The saturator 120 is configured for gradient chilling as described above with the highest temperature/enthalpy water 126 being at the top of the saturator 120 along with the highest temperature portion of the pre-cooled air in 115 and the chilled or cooler water (e.g., lower enthalpy water) 128 being near the bottom of the saturator 120 or near the water outlet of the saturator 120 along with the coolest portion of the pre-cooled air 115. The gradient for the water in the saturator 120 is obtained due to feeding the hot water 126 in at the top of the saturator 120 and using gravity for flow, but the gradient in the pre-cooled air 115 fed into the saturator 120 is achieved by the special configuration of the heat exchanger 114.

Returning to the system 100 of FIG. 1, the chilled or cooled water 128 is fed into a sump or to a chilled water storage 130, and, in some embodiments, a single water storage 130 is provided for the plurality of or set of chillers/subunits 110 rather than one per chiller/subunit 110 (as shown in FIG. 1). A level control 132 may be used to determine when water from a fill source 134 should be added to maintain a preset volume of water in the system 100 (or simply in the sump or storage tank 130). One or more pumps 138 and associated piping, valves, and other plumbing components are provided to allow the chilled water in the storage or sump 130 to be used to cool or condition the building or interior space 140. In some applications, it may be desirable to further reduce the temperature of the water 128 exiting the chiller 120 such as when the wet bulb temperature of the pre-cooled air 115 is not low enough to provide desired cooling to the building 140. In these cases, an optional supplemental cooler 142 may be provided to further cool the water 128 prior to its use for cooling the building 140. Alternatively, a cooling coil or other technique may be used to reduce the temperature of the water in the storage or sump 130 to lower the temperature of the chilled water supply 143.

The chilled water supply 143 is then used to cool the space 140 such as by passing the chilled water supply 143 through the liquid or tube side of air-to-water heat exchanger 144 as shown. The hot recirculation water 139 is then returned via piping to the chiller 110 as shown at 126. A fan 150 is used to provide air 146 that flows through the exchanger 144 and is cooled by the chilled water 143. The cooled air 147 is recirculated via a ventilation system 148 to the interior space 140. In some cases, the heat exchanger 144 may not provide adequate cooling capacity for the space 140, and a conventional or other cooler such as a compressor-based A/C unit 160 may be used to supplement the heat exchanger 144. A conventional thermostat(s) and/or a controller(s) 170 typically are provided as part of the cooling system 100 to control operation of the exchanger 144 (such as by controlling the ventilation system and fan 150 and/or by controlling the volume of chilled water supply 143 and operation of the optional supplemental cooler 142). Although not shown, control equipment often is provided with the chiller 110 to control its operation such as by selectively operating the fan (e.g., on/off, direction, speed, and the like), operating refill pumps associated with source 134 and level control 132, controlling flow of water 126 into the saturator 120, or operating louvers or other devices limiting flow through fan 112 to set volume and/or rate of air in and out 113, 118.

Alternative configurations of pumps and piping may be advantageous. For example, it may be desirable to separate the water loop used in the chiller 110 from the water used in the cooling system of the interior space 140, so as to reduce oxygen and contaminant levels in the interior water and thereby slow the rate of corrosion in the air-to-water heat exchanger 144. This can be achieved by pumping chilled water with pump 138 into one side of a counter-current water-to-water heat exchanger and into pipe 126 to the top of the saturator 120. A second pump is placed to pump water from the air-to-water heat exchanger 144 into the second side of the water-to-water heat exchanger and back to the optional supplemental cooler 142, thus creating two separate water flow loops. A second alternative configuration would place the optional supplemental cooler 142 within the chiller 110 rather than in the interior space 140.

A third alternative configuration would separate the water flow through the saturator 120 from the water flow through the interior space 140. This would be particularly useful, for example, when a large volume of chilled water storage 130 is employed. One pump moves water from the top of the storage vessel 130 to the top of the saturator pad/packing 124, the chilled water then being allowed to drain 128 or be pumped through a pipe leading to the bottom of the storage vessel 130. Chilled water for cooling the interior space 140 is pumped from the bottom of the storage vessel 130, and hot water returning from the air-to-water heat exchanger 144 is piped to the top of the storage vessel 130. Thus, a thermal gradient will form in the storage vessel 130 such that the warmer water is at the top. Separating the saturator loop from the interior space cooling loop allows the chiller 110 to operate and accumulate chilled water independent of the demand for cooling in the interior space 140. This would facilitate chilling of stored water at night to utilize off-peak power, utilize cooler night-time wet-bulb temperatures, and allow downsizing of the chiller 110. Many other configurations of the system 100 components are possible and would be apparent to those skilled in the art.

Figure 2:
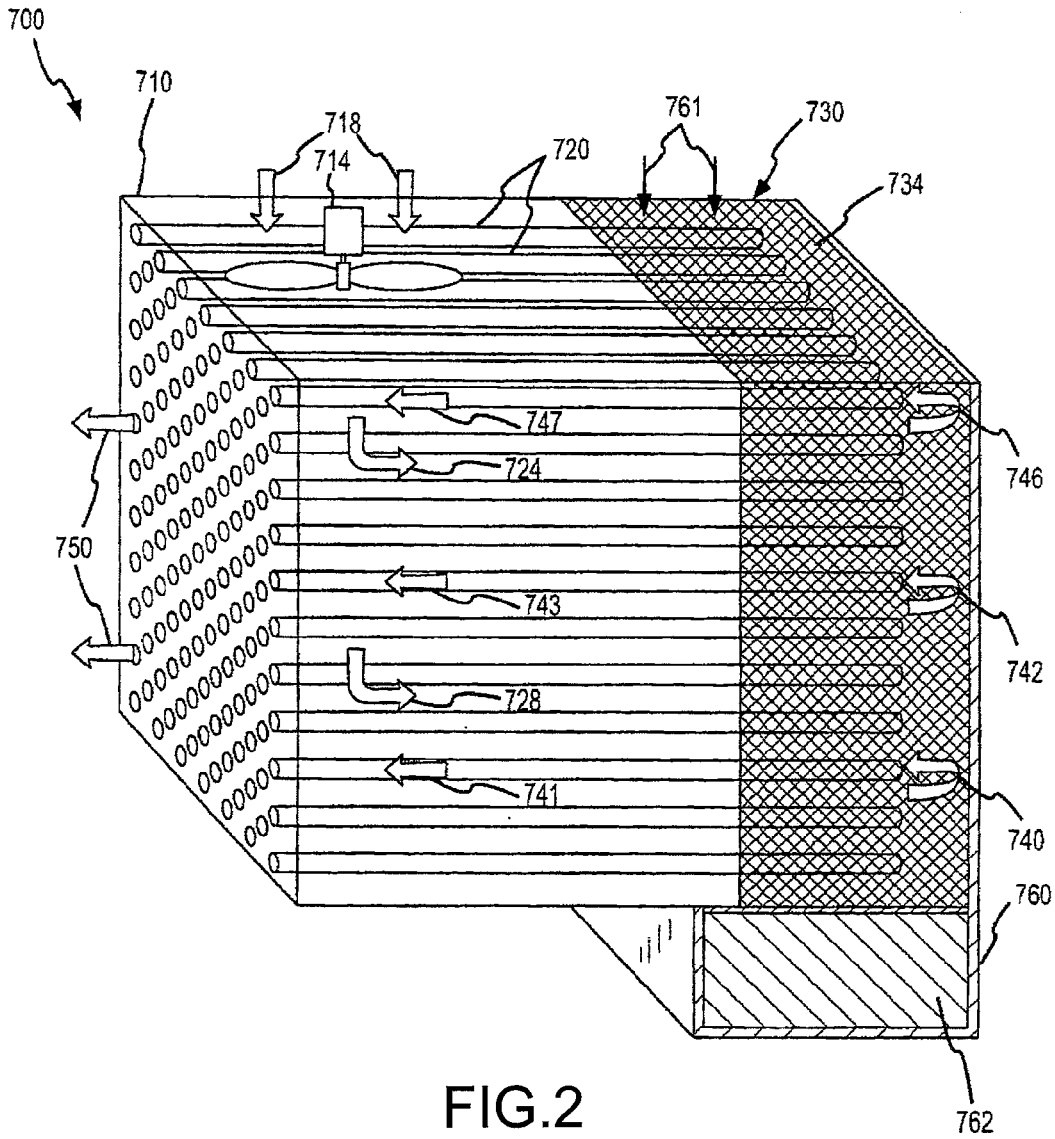
FIG. 2 is a perspective view of an embodiment of an evaporative chiller or subunit for use in cooling systems of the present description with the chiller utilizing tubing for return or exiting air so as to provide an air-to-air heat exchanger that is of a tube or tube-channel configuration.

As discussed above, the pre-cooling of the system 100 may be achieved with an air-to-air heat exchanger positioned in the chiller cabinet generally upstream of the saturator, and the form of the heat exchanger 114 may be varied to implement the system 100. For example, the chiller or subunit 700 of FIG. 2 utilizes a plurality of tubes to define channels or pathways for incoming air 718 and outgoing air 750 from the chiller to cause the two air streams to flow in a counter-current manner and to achieve cross-current flow of the air and water in the saturator 730. As shown, the chiller 700 includes a frame or cabinet 710 that defines an interior space in which a plurality of tubes 720 (e.g., metal, thin plastic or other materials having high heat transfer coefficients) is arranged in a spaced apart manner and with their elongate axes transverse or orthogonal to the vertical axis or plane of the chiller 700.

Incoming air 718 is drawn into the chiller cabinet 710 by one or more fans 714 and flows in channels or passageways 724, 728 defined by the outer surfaces of the tubes. The incoming air is cooled in layers or gradients from the top to the bottom by outgoing air 741, 743, 747 in the tubes with this air being warmer in the top tubes (such as stream 747) and cooler as it approaches the bottom of the chiller (such as streams 743 and even cooler in stream 741). The pre-cooled air 724, 728 passes through saturator medium 734 (such as one or more pads or the like) and returns at 740, 742, 746 by entering the tubes 720. Water to be chilled 761 (e.g., water with increased enthalpy from a building heat exchanger or other cooling system device) enters the top of the saturator 730 and is cooled by evaporation via contact with the pre-cooled air 724, 728, and the chilled water 762 drains by gravity to the sump 760.

Figure 7:
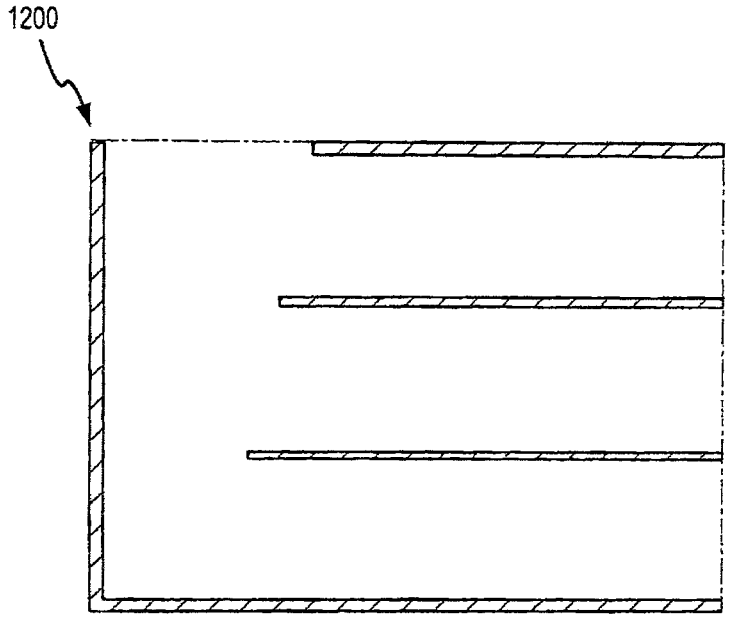
FIGS. 7 and 8 illustrate exemplary spacer designs for use with the chiller of FIGS. 5 and 6.

As shown, the tubes 720 are a set of parallel and relatively closely spaced tubes that allow the incoming ambient air 718 to pass between them as shown at 724, 728. The air 724, 728 gives up heat to the outgoing or exiting air 747, 743, 741 that is flowing within the tubes 720 before the air exits at 750. The saturator 730 in some embodiments is made up of material 734 interposed between the tubes 720 and/or that is provided at the end of tubes 720 where return or recirculated air 740, 742, 746 is shown in FIG. 7 as reversing its direction. Suitable material for pads, packing, filler, or the like 734 includes high wettable paper, wood fiber, plastic, or any other material that creates or provides a large surface for water flow 761 to sump 760. The tubes 720 typically are thin-wall tubes formed from plastic and more typically metal or other thermally conductive material.

Figure 3:
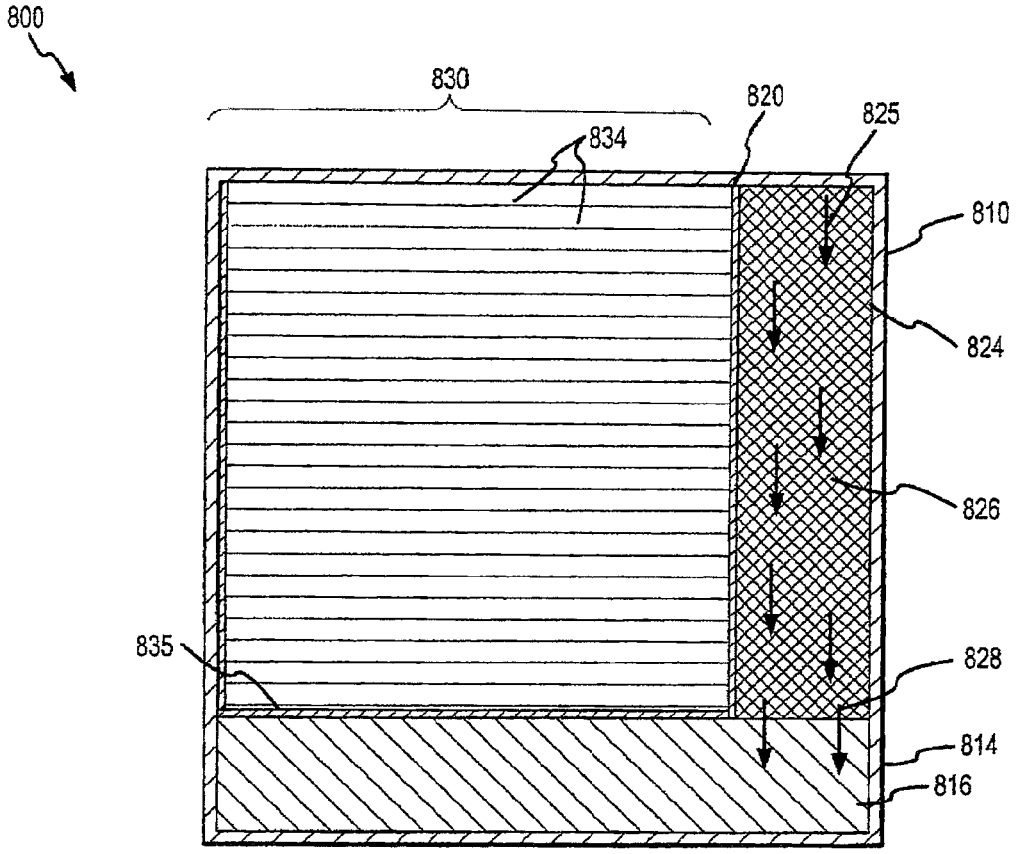
FIG. 3 is a sectional side view of an embodiment of an evaporative chiller or subunit for use in a multiple chiller cooling system that provides an air-to-air heat exchanger for providing pre-cooling with a plate configuration for providing flow channels for inlet and outlet/return air.
Figure 4:
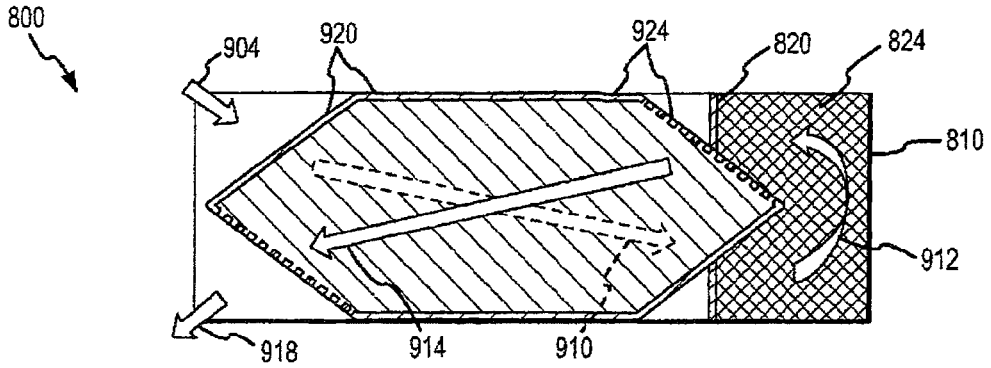
FIG. 4 is a top view of the chiller of FIG. 3 showing one exemplary, but not limiting, example of a configuration for the plate air-to-air heat exchanger.

In other preferred embodiments, the pre-cooling is achieved with air-to-air heat exchangers arranged as or configured to provide plate heat exchangers, horizontal plate heat exchangers, or the like. FIGS. 3 and 4 illustrate side and top views, respectively, of a chiller or subunit 800 of an evaporative cooler system (such as system 100 or the systems in the following figures) that includes a counter-current air-to-air heat exchanger 830 upstream of a saturator. Again, a cabinet or frame 810 is provided with an air inlet and air exit and a water inlet/return. As shown, the incoming air 904 enters the heat exchanger 830 at the top or side of the cabinet 810 and passes through the passageway adjacent the heat exchanger plates, and the outgoing air 918 exits the heat exchanger 830 at the front left of the cabinet 810.

The heat exchanger 830 is shown to be made up of a plurality of horizontally extending plates 834 (e.g., thin metallic plates or other plates with relatively high heat transfer coefficients or rates). The plates 834 may be planar as shown or be textured or have a "W", "S", or other cross section to obtain additional heat transfer between incoming air 904 and outgoing air 918 from the saturator. The incoming air 904 and the outgoing air 918 are caused to flow in the space or channel between alternating pairs of the plates 834 so as to allow the incoming air 904 to give up heat to the cooler outgoing air 918 as is shown at 910 to represent incoming air below the top plate 834 and at 914 showing outgoing air flowing above the top plate 834.

The air 910 becomes pre-cooled air or air at a temperature below the temperature of the incoming ambient air 904 and passes through the saturator media 824 as shown at 912 where it (i.e., the recirculating air) loses further heat during the evaporation process and is returned as air 914 where it is used to cool the incoming air 910. Spacers 920 and 924 are used between the plates 834 to control the flow of the incoming and outgoing air or to define the flow paths for the incoming air 904 and the recirculated air 912 such that the airstreams 910, 914 remain in adjacent and alternating airflow passages between the plates 834. Generally, the heat exchanger 830 is constructed of alternating layers of conductive "plates" 834 and spacers 920, 924. The shape of the plates 834 at the ends used to define the inlet and outlet passageways for the air 904, 918 may be triangular as shown, circular (e.g., a semi-circle or the like), or any other useful configuration for defining the air passageways (or may even include ducting or the like to define an inlet and outlet manifold or similar arrangement).

The chiller 800 further includes the saturator that is defined by porous sidewalls 820 and the inner side of the frame or cabinet 810 and by the pads or saturator medium 824. Return or higher temperature water is input at the top of the saturator (e.g., through a water inlet or return pipe outlet at the top of the cabinet 810). The higher enthalpy water 825 flows by gravity through the pad or medium 824 where it contacts the pre-cooled air 912 and becomes chilled as it flows downward in the chiller from 825 to point 826 to the bottom of the saturator at 828. The medium 824 may be a single large saturator pad provided at the right end of the chiller cabinet 810 as shown or multiple pads or media may be used. Alternatively, a thinner pad or pads could be applied flush against the right end of the heat exchanger stack 830, leaving an open space for air reversal 912 at the right end of the cabinet 810.

The chilled water 816 is stored in the sump 814 (or a storage tank or sump in some cases that is fed by each of plurality of chillers or subunits of a multiple subunit/chiller system). The sump 814 is typically connected to a cooling system such as a residential or commercial building heat exchanger (air-to-water or the like), which results in the water increasing in enthalpy and/or temperature at which point it is returned to the top of the saturator for chilling. The use of horizontal plates 834 and the cross-flow of the air 912 relative to the water 825, 826, 828 results in the chilling gradient being maintained (as discussed in detail for other chiller embodiments). Of course, although not shown, a fan or other mechanism for forcing the air to flow through the heat exchanger and saturator would be provided in the chiller 800 such as at the air inlet or outlet or adjacent to the heat exchanger 830.

Figure 6:
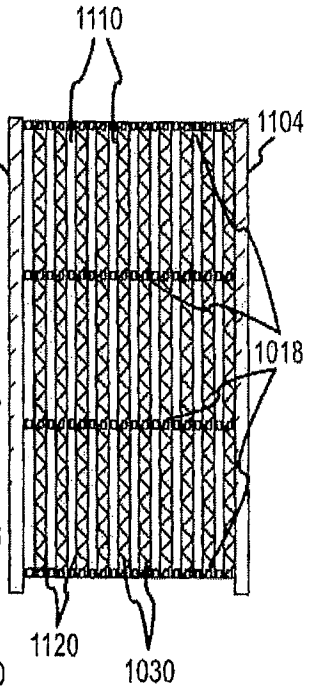
FIG. 6 is a sectional side view of the chiller of FIG. 5 showing the positioning of saturator pads/packing in return flow channels.

FIGS. 5-8 illustrate another embodiment of a chiller or subunit 1000, for use in a multiple subunit/chiller evaporative system such as system 100 of FIG. 1 or the following figures, that uses an air-to-air heat exchanger to pre-cool incoming air 1015 with outgoing air 1037, 1039, 1041. The chiller or subunit 1000 includes a cabinet or frame 1010 with a solid sidewall 1012 and a sidewall 1050 with openings to allow the outgoing air 1037, 1039, 1041 to exit from its flow or return channels in the heat exchanger. One or more fans 1014 are provided at the air inlet of the cabinet 1010 to draw ambient air 1015 at the ambient air temperature and humidity. As shown in FIG. 6, the heat exchanger is achieved with side-by-side vertical plates (e.g., heat conductive metal plates) 1120 with spacers 1018 that are configured to define flow paths for the incoming air 1015 and control flow of the exiting air 1037, 1039, 1041 in layers or non-mixing gradients (with three layers being shown but two layers or more than three layers may be used). The spacers 1018 provide openings 1022, 1026, 1029 through which portions 1020, 1024, 1028 of the incoming air 1015 flow in the channels or passageways 1110 between the plates 1120.

Figure 8:
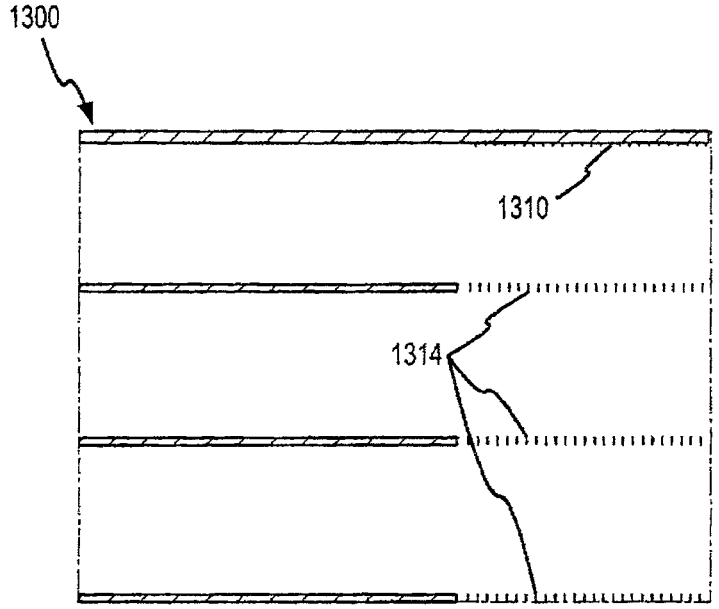

This pre-cooled air in channels 1110 reverses direction 1036, 1038, 1040 and flows through saturator pads or media 1030 that is positioned between the plates 1120 at one end of the outgoing air passages or passageways/channels 1030 (with an opening or space typically provided between the end of the incoming air passage 1110 and the wall 1012). The frame 1010 further includes front and back sidewalls 1102, 1104. Incoming water 1034 enters the chiller at the top of the saturator pads 1030 and is cooled by evaporation of water in the pre-cooled air 1036, 1038, 1040 before it is returned to the sump 1060 as chilled water 1062 (e.g., water at or near the wet bulb temperature of the pre-cooled air 1036, 1038, 1040 (such as at or near the wet bulb temperature of the air 1036 due to gradient chilling in the saturator)). FIGS. 7 and 8 illustrate a representative spacer assembly 1200 for defining incoming air passages and a representative spacer assembly 1300 for defining outgoing passages. A water distribution pipe 1310 is include in the outgoing spacer assembly 1300 as are perforations 1314 for water flow at one end (e.g., the saturator end) for water flowing in the saturator pad(s).

Figure 5:
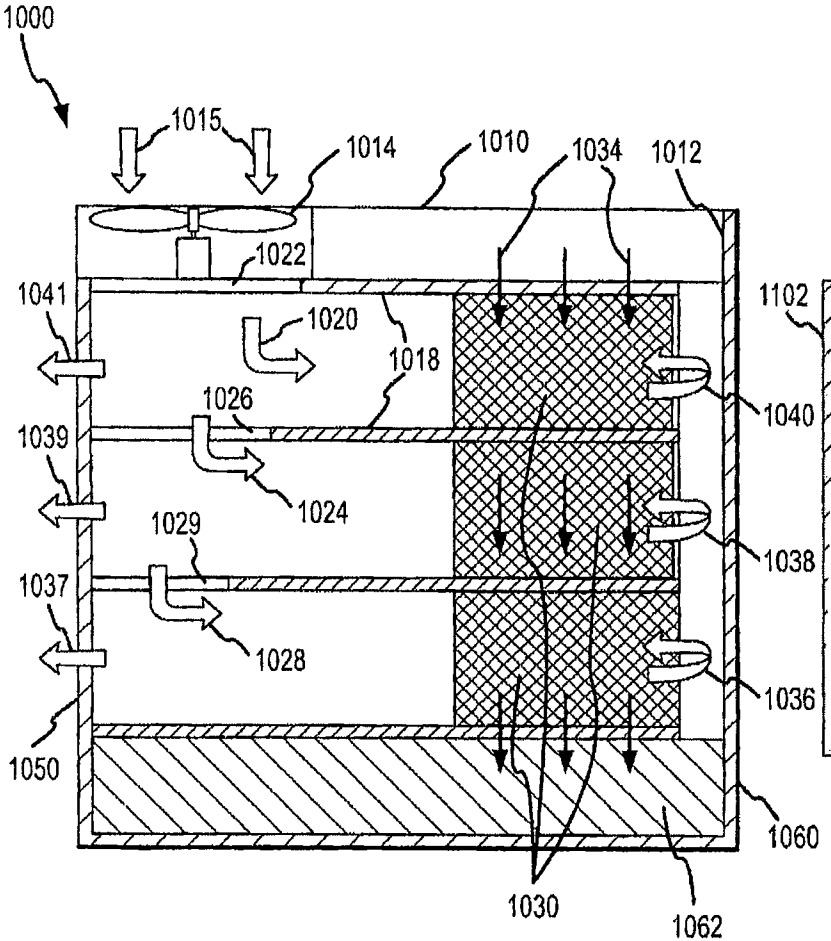
FIG. 5 is a sectional or cutaway side view of another embodiment of an evaporative chiller or cooling system subunit that pre-cools incoming or inlet air upstream of the saturator or water column using vertical plates and spacers to provide flow channels.

In the chiller 1000, the incoming airstream is pre-cooled by passing counter-current to the outgoing airstream in a flat or other cross section plate-based air-to-air heat exchanger positioned upstream of the saturator. As shown in FIGS. 5 and 6, vertical and parallel sheets of thin, conductive material are used to separate the incoming and outgoing airstreams but place them in adjacent heat transfer passages or channels. Several layers of alternating incoming and outgoing passages are employed in most preferred embodiments. These heat transfer sheets or heat exchange plates are separated using spacers, such as those shown in FIGS. 6-8, in alternating layers of spacers.

A fan is placed at the top of the unit to force ambient air down between the plates as shown. This air then passes to the right (in this example) until it reaches an open chamber at the right end of the device or cabinet in which the air can reverse direction to flow and enter the outgoing passages. In the outgoing passages, material or saturator media is placed that is wetted during operation of the chiller 1000 by a vertically flowing stream of water (e.g., this portion of the chiller is considered the saturator). This may take the form of water passing down the walls of the heat exchanger passages but more typically includes some wettable material that is interposed between the walls or in the outgoing or return air passages.

For example, a zigzag shaped, thin, wettable "pad" could be used as shown in FIG. 6. The saturator material preferably does not occupy a significant amount of the passage space to control pressure drop of the pre-cooled air but is adequate to allow sufficient saturation of the passing air with water. The heated water from the building interior is typically pumped to the top of the saturator pads by a pump (not shown) and flows downward over the pads by the force of gravity. Below the saturator, an insulated sump is provided for receiving and storing the draining chilled water. The airstream then exits at the left-hand side of the device as shown in this example. The number of heat exchange plates and the dimensions of the passages may be varied to practice the invention, and may be determined to obtain a desired efficiency of heat transfer, to suit fan power limits, and to control or based on fabrication costs. Air and water flows are typically determined by the amount of cooling (e.g., desired tonnage) required and anticipated temperature differentials where the chiller is installed for use. The surface area of the saturator pads preferably is sufficient to accommodate the required total water flow while maintaining thin film flow over the surfaces. The saturator pads can occupy the full length of the outgoing air passages in some embodiments or, as shown, only a portion on one side/end of the passage. Water can be distributed evenly along the tops of the saturator pads or unevenly (e.g., a higher flow rate may be desirable on the end of the saturator pads nearer the inlet to the pre-cooled air into the saturator region of the chiller). A mechanism may also be provided to maintain the water level in the sump, such as a float valve that allows water to be added or to flow into the sump when the level drops below a preset level. Additionally, an anti-scale filter on the incoming fresh water or fill water may be useful in some implementations. For added saturation of the airstream, the water entering the saturator may be introduced using misters or fill water entering the sump may be added by spraying with misters or the like in the opening or gap at the edge of the cabinet between the pads and the cabinet end or side wall.

Fabrication of the chiller 1000 involves engineering different spacer sets such as those shown in FIGS. 7 and 8 for the incoming and outgoing air channels/passageways. The heat exchanger stack is composed of alternating layers of spacers and plates. The heat exchanger plates or material is typically thin and formed of thermally conductive materials such as metal but plastic and other materials may be used. The sheets may be relatively rigid or can be formed from thin relatively flexible material that is pulled or tensioned to be taught or planar. The spacers can be formed from metal, plastic, foam, rubber, wood, or other materials. To ease fabrication and provide support, the "open" regions of spacer sets may also be of material configured with perforations or with an open, corrugated, or honeycomb design to allow air to flow through. The saturators may be made of a material such as wood or paper fibers, plastic mesh, fabric, glass fibers, metal fibers, a honeycomb arrangement of such materials, or the like and preferably is configured to be highly wettable. Note, in the chiller 1000 and similar designs, the gradient chilling effect is maintained by the horizontal partitions included in the spacer configurations shown in FIGS. 5-8, and the spacers are preferably formed of a nonporous material and are arranged to block or limit vertical mixing (i.e., maintain temperature stratification) of both the incoming and outgoing air such that the incoming ambient air is effectively and efficiently pre-cooled by the outgoing, cooler air.

For these chiller or subunit designs, the efficiency of cooling of the chilled water is very high. The only electrical requirements are for the relatively low power fan(s), one or two small pumps, and control circuits. Further, in some residential and smaller commercial embodiments, the movement of the water from the sump to the top of the saturators is achieved using a small recirculation pump (submersible in the sump or non-submersible located adjacent to the sump). As described for the system 100 of FIG. 1 above, one pump could be used to move water into the building with the return water entering the device at the top of the saturator or two or more separate pumps could be used. The total electricity usage is very low relative to compressor-based air conditioning, resulting in higher EER or SEER ratings than conventional A/C systems. Each chiller is designed to chill water to below the ambient wet-bulb temperature. Each chiller also establishes a gradient such that the coolest air and water temperatures are found at the bottom of the cooler (i.e., the gradient chilling principle). Each of these chillers also can be designed to fit inside a cabinet that integrates well with a residential or commercial building, perhaps having a depth of two feet or less.

The chiller embodiments of the description are also compatible with chilled water storage. In one embodiment, this is achieved by increasing the volume of the sump; i.e., the chiller is placed over an underground, insulated tank into which the chilled water can flow. A volume of several hundred or thousands of gallons, depending on the application, allows storage of substantial cooling power for use during the hottest parts of the day. This could defer electric loads to off-peak (e.g., nighttime and morning) hours and/or allow the equipment to be down-sized so that the chiller runs for a large fraction of the day even though cooling may only be required during a small fraction of the day. This application also benefits from the use of cooler nighttime ambient dry bulb and wet bulb temperatures for chilling the water. Both efficiency of cooling and the temperature achieved likely benefit from the lower temperatures at night, and water usage would be lower as a result.

The chillers described are also generally compatible with backup air conditioning (A/C). One application or embodiment for using any of the chiller designs would be to have the chiller and A/C as independent systems with the thermostats set such that the A/C only comes on if the chiller system is unable to keep up with the cooling demand. An alternative application would be to pass the water stream from the chiller through a backup compressor-based chiller unit as in FIG. 1 such that the unit could further cool the water when necessary. This would eliminate the need for redundant heat exchangers in the building. The heat from the compressor unit could be dumped to ambient air, to the water stream coming from the house and going to the chiller, or to another sink. The A/C efficiency would be enhanced by using the relatively cool (e.g., around 75° F.) water stream to remove heat. Another embodiment or application for the chillers presents itself with the chilled water storage option. In this embodiment, an A/C coil in the cool water storage tank further chills the water in the morning hours (for example, from 5:00 AM to 10:00 AM) when and if the chiller is unable to reach the desired tank temperature during the night. This defers the backup A/C electric load to off-peak hours as well.

Now, with this understanding of sub-wet bulb evaporative chillers and the gradient chilling concept in mind, the following description explains how a plurality of such chillers may be integrated into a single unit or cooling system for cooling of buildings and other applications. The new design of the cooling system may be particularly well suited for use with the horizontal plate-based chiller design, and, while it is understood that any of the air-to-air heat exchangers may be used, the following description highlights use of the heat exchangers with horizontal plates (or sheets) of metal, plastic, or other material defining air flow channels or passageways.

More specifically, in a cooling system with multiple, integrated chillers or subunits, a cross-current or partially cross-current, air-to-air heat exchanger with horizontal and parallel plates is used together with a saturator in each subunit/chiller. In previously described chillers, air flows horizontally through the saturator in a cross-flow configuration with the water flowing vertically downward through the saturator under the force of gravity. The previously described heat exchanger is arranged in conjunction with the saturator such that air first passes through every other passage between the plates, then flows through the saturator, and then flows back through the heat exchanger through the intervening passages between the plates (in channels or passageways adjacent sides of the channels or passageways containing the incoming ambient air). Such a configuration is shown in the unit 800 shown in FIGS. 3 and 4, which used partially counter-current horizontal plate heat exchangers.

Figure 9B:
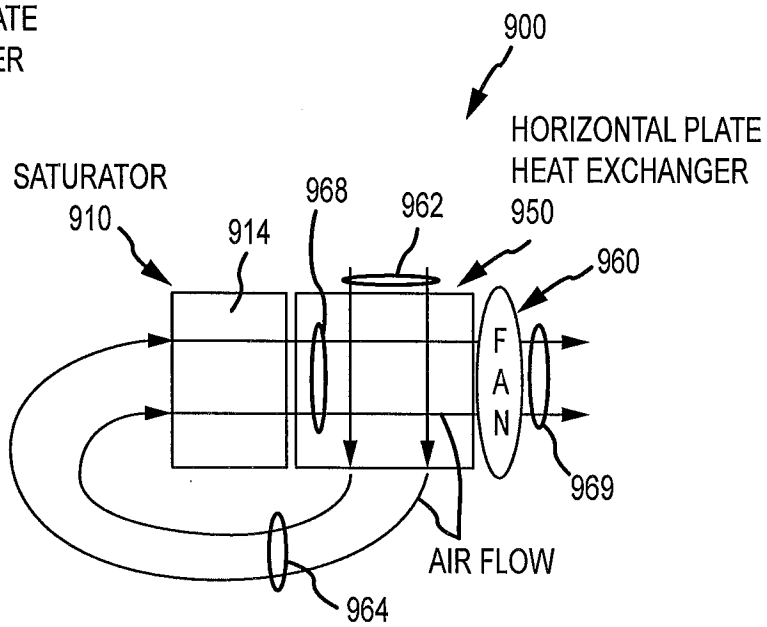
FIGS. 9A and 9B illustrate side and top views, respectively, of a sub-wet bulb evaporative chiller showing water and air flows for a standalone device.
Figure 9A:
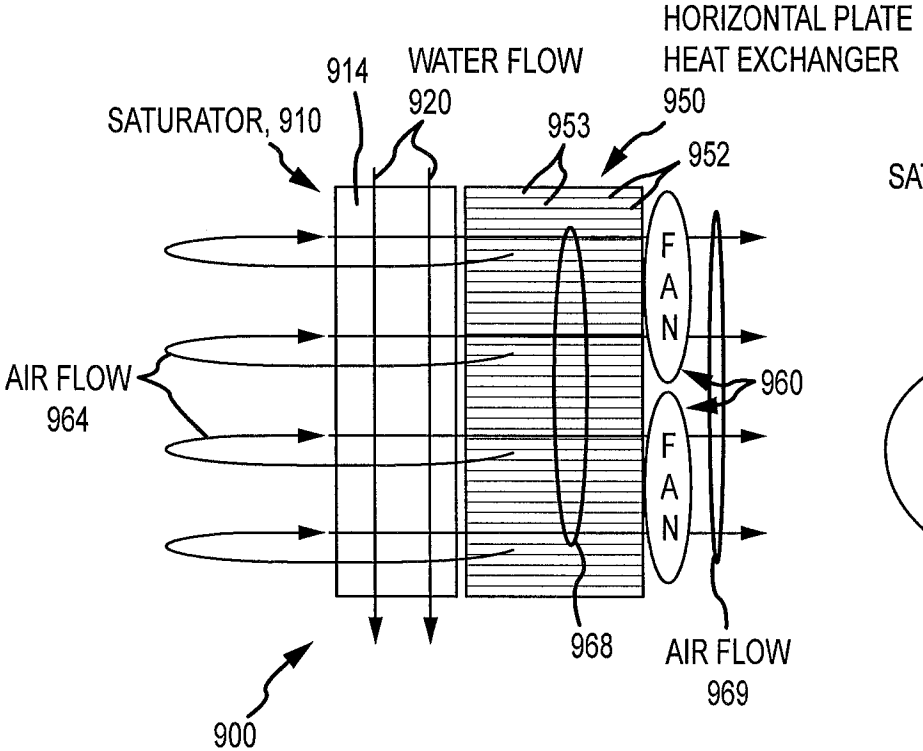

As a further example of this configuration, FIGS. 9A and 9B illustrate side and top views, respectively, of a sub-wet bulb evaporative chiller 900. In the side view of FIG. 9A, the side walls of the heat exchanger are removed to show air flow channels/passageways showing water and air flows when such a chiller is used as a standalone device (rather than in a multiple, integral cooling system as taught herein by the inventor). Specifically, the chiller 900 includes a saturator 910 with a pad/packing 914 and a horizontal plate-based heat exchanger 950. The heat exchanger 950 is an air-to-air device with a plurality of horizontal, parallel plates 952 that are spaced apart to define a stack of side-by-side air flow channels or passageways 953.

The chiller 900 may be thought of as the basic subunit or an exemplary chiller that may be used within a cooling system of the present description (but, as explained, with differing air flows defined in the system). The chiller or subunit 900 is made up of: one horizontal, plate-based air-to-air heat exchanger 950; one saturator 910 juxtaposed to the heat exchanger 950; and one or more fans 960 operable to move air through the chiller or subunit 900.

FIGS. 9A and 9B provide flow paths for water and air. Particularly, water 920 flows vertically, under gravity, through the pads/packing 914 of the saturator 910. In contrast, the fan(s) 960 is operated to draw air into the heat exchanger 950 as shown at 962, and the incoming air 962 flows through every other flow channel or passageway 953 defined by the plates 952 (or a first set of horizontal flow channels 953 in exchanger 950). The pre-cooled air then exits the heat exchanger 950 and is directed to flow through the saturator 910 in a horizontal manner (with a vertical temperature gradient as explained above) as shown at 964. The cool return air, as shown at 968, then flows from an outlet of the saturator 910 through the other (or a second) set of alternating or every other passageway or channel 953 in the heat exchanger 950 to transfer heat from or pre-cool the intake air 962 (e.g., the incoming air 962 gives up heat to the outgoing cooled air 968 in the heat exchanger 950 before entering the saturator 910 as shown at 964). The fans 960 then eject the hot air out from the heat exchanger 950 as shown at 969.

In the example of FIGS. 9A and 9B, the square (as viewed from above) heat exchanger 950 is completely cross-flow in its configuration (as seen with air flows 962 and 968). The design of chiller 900 requires that the air flow 964 make a turn, i.e., air passes through the heat exchanger 950 in one direction and must then rotate its path, (e.g., in FIG. 9B, the flow of air 964 rotates 270 degrees) in order to pass back through the heat exchanger 950 as shown at 968 (with the saturator 910 intervening somewhere the two transits of the heat exchanger 950). Turning the airstream 964 has at least three disadvantages including: (1) redirecting air flow creates back pressure and, therefore, increases the fan power required to move the air through the chiller 900; (2) turning the air stream creates non-uniform flows such that the air velocity will be different in differing parts of the saturator 910 and heat exchanger 950, which decreases the efficiency of the heat exchange and evaporation; and (3) extra space is required to affect the turn of the air stream, which increases the size of the chiller 900 (for ducting and the like not shown in FIGS. 9A and 9B).

With these disadvantages in mind, the cooling systems and related design concepts presented by the invention in this description are intended to reduce or eliminate the turning of the airstream between the heat exchanger and the saturator. Significantly, turning can be eliminated (or significantly reduced) by integrating or combining multiple subunits or chillers (such as chiller 900 of FIGS. 9A and 9B) into a single cooling system (or sub-wet bulb evaporative chiller unit or assembly).

Figure 10:
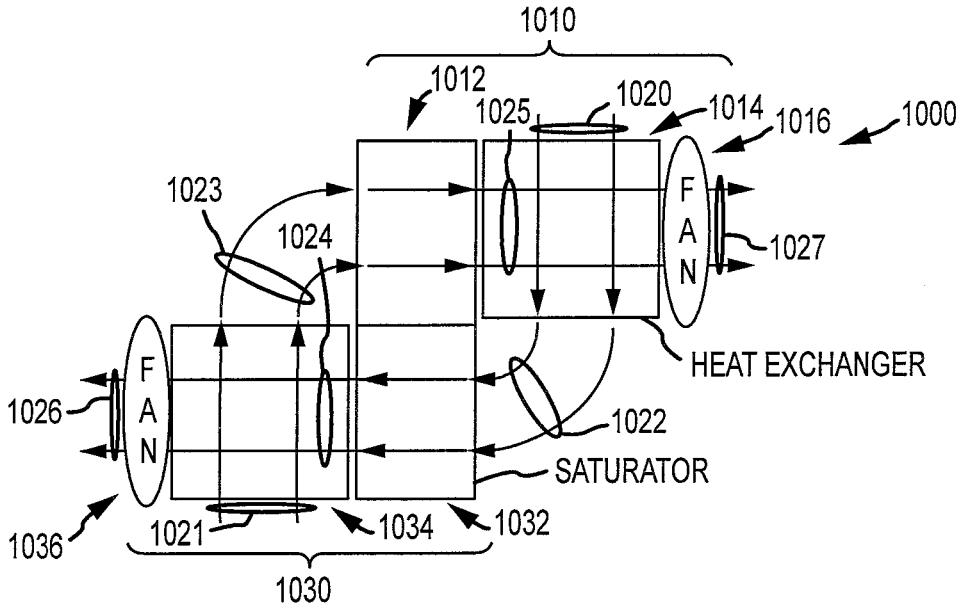
FIG. 10 illustrates a cooling system or assembly in which multiple subunits or chillers are combined into a single sub-wet bulb evaporative chiller unit, with a cross-flow provided in the heat exchangers.
Figure 11:
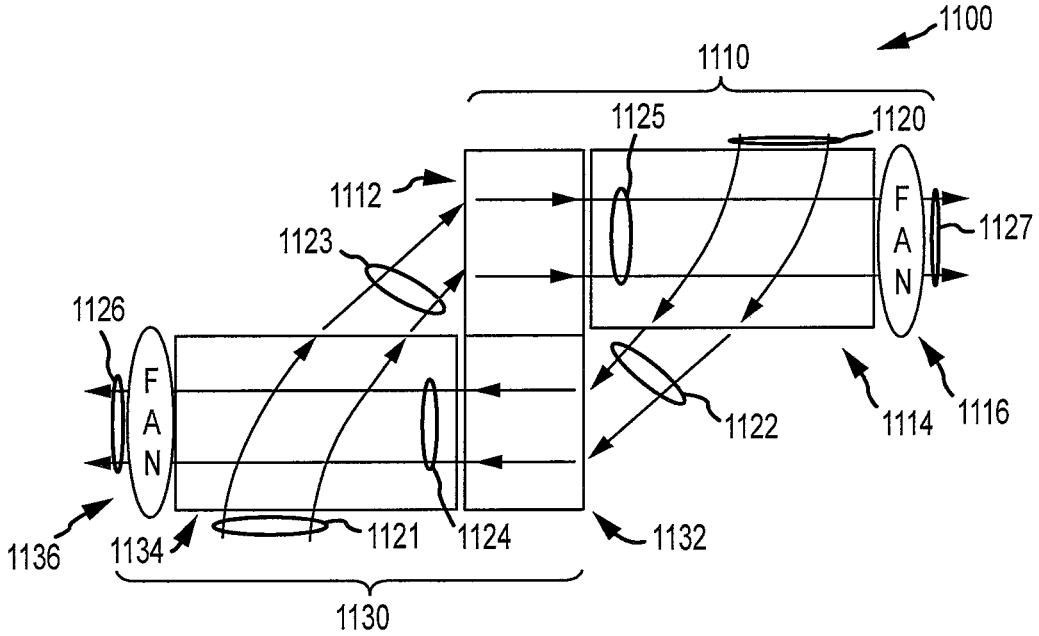
FIG. 11 illustrates a cooling system similar to that of FIG. 10 but utilizing or integrating partially counter-flow heat exchangers rather than cross-flow heat exchanger designs.

FIGS. 10 and 11 illustrate cooling systems or assemblies 1000 and 1100 in which multiple subunits (i.e., two in these simple examples but, often, more subunits will be used) are combined into a single sub-wet bulb evaporative chiller unit. By integrating subunits, the exhaust of one saturator is used to cool the input for the other and vice versa. FIG. 10 shows a completely cross-flow arrangement (with heat exchangers 1014, 1034) while FIG. 11 shows a partially counter-flow arrangement (with heat exchangers 1114, 1134). By directing the exhaust of saturators from adjacent or neighboring chillers/subunits into the heat exchangers of adjacent or neighboring chillers/subunits, the amount of turning of the airstream between heat exchanger and saturator is significantly reduced, such as to a simple 90 degree bend in system 1000 or to about a 45 degree bend or redirection in system 1100.

More particularly, in the cross-flow arrangement of system 1000, a first chiller or subunit 1010 is combined or integrated with a second chiller or subunit 1030. Each chiller 1010, 1030 includes a saturator 1012, 1032, a horizontal plate, air-to-air, heat exchanger 1014, 1034, and one or more fans 1016, 1036, which may take the form of the chillers discussed earlier (e.g., see FIGS. 3, 4, 9A, and 9B or the like) to provide vertical temperature gradients in both the water flow paths and in the air flow paths. The saturators 1012, 1032 are placed adjacent to each other so as to be sandwiched between the two heat exchangers 1014, 1034.

As shown in FIG. 10, ambient air in 1020 for heat exchanger 1014 is directed through the alternating ones of the channels between plates in a first direction (e.g., downward in the figure). The air 1020 is cooled by cool return air 1025 flowing in a cross-current or orthogonal manner in exchanger 1014, which is then ejected from the system 1000 by fan 1016 as shown at 1027. The pre-cooled air 1022 is turned 90 degrees before it is directed through the saturator 1032 of the second chiller 1030. Upon exiting the saturator 1032, the cool return air 1034 passes through the horizontally arranged flow channels of the heat exchanger 1034 of the second chiller 1030 to be used to cool incoming ambient air 1021, which flows in a cross-current or orthogonal direction in heat exchanger 1034 relative to air flow 1024. The hot air 1026 is then ejected from the system 1000 by the fan 1036 of the second chiller 1030. Hence, the air 1024 is flowing in a second direction in exchanger 1034 that is orthogonal to the first direction of the ambient air 1020 in the exchanger 1014 but in the same plane.

The pre-cooled air 1023 output from the second chiller 1030 is turned from its first direction of flow through the exchanger 1034 about 90 degrees and directed to flow through the saturator 1012 of the first chiller 1010. The cool return air 1025 output from the saturator 1012 flows in its second direction, which is orthogonal to the first direction of air flow 1021, through the heat exchanger 1014 of the first chiller 1010. The cool return air 1025 flows in a cross-flow manner relative to the ambient air flow 1020 in the plate exchanger 1014 in every other one of the flow channels or passageways of the heat exchanger 1014, and the hot air 1027 is then ejected from the system 1000 by fans 1016. The relative placement of the components of the system 1000 is relatively flexible as long as the saturators 1012, 1032 are positioned so as to intervene in the air path between the two transits of the heat exchangers 1014, 1034.

Similarly, the cooling system 1100 integrates a first chiller 1110 and a second chiller 1130 to provide pre-cooled air flows 1122, 1123 from the heat exchangers 1114, 1134 to the saturators 1132, 1112 of the other chiller 1110, 1130. Each chiller 1110, 1130 includes a saturator 1112, 1132, a horizontal plate, air-to-air, heat exchanger 1114, 1134, and one or more fans 1116, 1136, which may take the form of the chillers discussed earlier (e.g., see FIGS. 3, 4, 9A, and 9B or the like) to provide vertical temperature gradients in both the water flow paths and in the air flow paths. The saturators 1112, 1132 are placed adjacent to each other so as to be sandwiched between the two heat exchangers 1114, 1134. The heat exchangers 1114, 1134 are configured for partial counter-flow of the two contained air streams rather than full cross-flow as in system 1000 to obtain increased efficiency but with a larger footprint for the cooling system 1100. The discussion of the systems 1000, 1100 is useful for illustrating that the basic concepts of integrating sub-wet bulb evaporative chillers taught by the inventor are compatible with either type of heat exchanger.

As shown, ambient air 1120 is drawn into and through the horizontal plate-based heat exchanger 1114 of the first chiller 1110 to flow at least partially counter (such as 30 to 60 degrees relative to) flow 1125 from saturator 1112, which causes the incoming air 1120 to give up heat to the outgoing cooled air 1125 that is discharged by fan(s) 1116 from the system 1100 as shown at 1127. The pre-cooled air 1122 is turned, such as 30 to 60 degrees, into the saturator 1132 to cool water flowing in its packing (as discussed above). The cool return air 1124 flows through the channels of the plate-based heat exchanger 1134 of the second chiller 1130, and ambient air 1121 drawn into the heat exchanger 1134 is pre-cooled (flowing with partial counter-flow such as at an angle of 30 to 60 degrees to flow 1124) and the hot air 1126 is output from the exchanger 1134 by the fan(s) 1136 of the second chiller 1130. The pre-cooled air 1123 flows outward at an angle from heat exchanger 1134 and is then turned, such as 30 to 60 degrees, into the saturator 1112 of the first chiller 1110 to cool water flowing under gravity within pads/packing. The cool return air 1125 then flows through the heat exchanger 1114 for discharge by fan(s) 1116 as shown at 1127.

Figure 12:
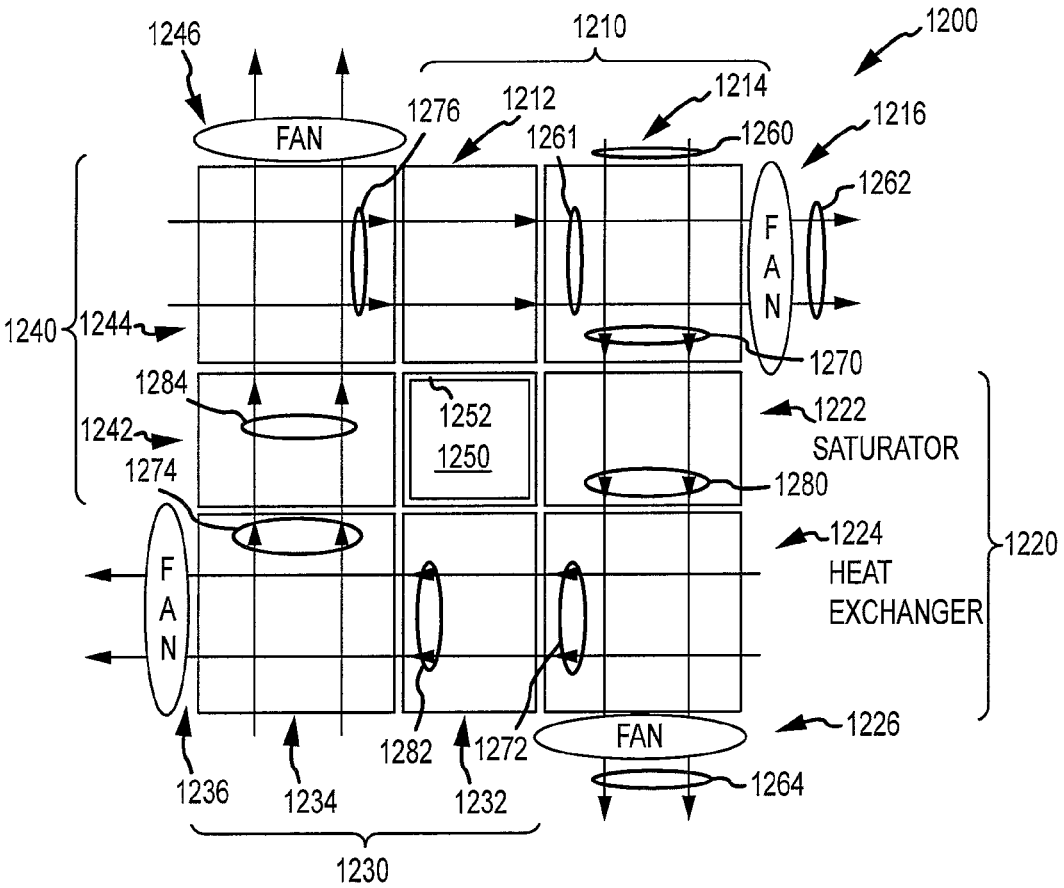
FIG. 12 is a top view of a cooling system integrating four chillers or subunits with airflow paths shown schematically with solid arrows through plate-based heat exchangers and saturators sandwiched between pairs of the heat exchangers.

As will be appreciated by those skilled in the arts based on the systems 1000 and 1100, any number of subunits or chillers may be joined together or integrated to have the pre-cooled air from a heat exchanger of a one chiller passed through the saturator of another chiller. However, the inventor has determined that the integration of four subunits or chillers is particularly attractive, and the cooling system 1200 of FIG. 12 provides an exemplary arrangement to integrate four chillers or subunits 1210, 1220, 1230, 1240 as viewed from above. The chillers 1210, 1220, 1230, 1240 may be sub-wet bulb evaporative chillers as discussed above adapted for maintaining temperature gradients. Each chiller 1210, 1220, 1230, 1240 includes a saturator 1212, 1222, 1232, 1242, a horizontal and parallel plate-based heat exchanger 1214, 1224, 1234, 1244, and one or more fans 1216, 1226, 1236, 1246.

In this example, each of the heat exchangers 1214, 1224, 1234, 1244 is configured for cross-flow as shown, for example, for exchanger 1214 with ambient air in 1260 and cool return air 1261, which are orthogonal to each other in adjacent or every other flow channel of the exchanger 1214, and the exchanger 1214 outputs hot air flow 1262 from the cooling system 1200. The four interacting subunits 1210, 1220, 1230, 1240 pass pre-cooled air streams 1270, 1272, 1274, 1276 from one to another (or the next chiller/subunit) in a "daisy chain" configuration (i.e., from the outlet of a heat exchanger of one chiller/subunit to the saturator of the next, adjacent chiller/subunit such as from heat exchanger 1214 to saturator 1222). Further, cool return air 1261, 1280, 1282, 1284 (or the exhaust of) from saturators 1212, 1222, 1232, 1242 of the four chillers 1210, 1220, 1230, 1240 is used in neighboring or adjacent heat exchangers 1214, 1224, 1234, 1244 to remove heat from the air being input to the next saturator.

As clearly seen in the cooling system 1200 of FIG. 12, the airflow paths are straight with no bending or turning between intake into a heat exchanger of a first chiller/subunit and exhaust from a heat exchanger of a second chiller/subunit. For example, intake ambient air 1260 flows straight through the heat exchanger 1214 of the chiller 1210, straight through the saturator 1222 of the chiller 1220, and then straight through the heat exchanger 1224 of the chiller 1220 prior to being exhausted by fans 1226 of the chiller 1220 as shown at 1264. Such straight airflow paths reduce fan power, allow for very uniform flow through the heat exchangers and saturators, and eliminate wasted space for ducting or other components used in other designs for turning airstreams. The only "empty" space in the cooling system 1200 is a central chamber 1250 defined by sidewalls 1252, which may serve as a chase for plumbing and/or wiring (not shown in FIG. 12) for the cooling system 1200.

In cooling system 1200, four fans 1216, 1226, 1236, 1246 are included, but more fans may be used such as if/when two or more fans are provided for each subunit or chiller 1210, 1220, 1230, 1240 in the vertical direction/dimension (such as shown in system 900 of FIG. 9A). Provision of multiple fans is not necessarily an issue because the cost of many small fans can be similar to or less than that of one large fan per chiller. However, it may be possible to duct together the outputs of the four heat exchangers 1214, 1224, 1234, 1244 so that as few as one fan may be used to provide the air flow for cooling system 1200. In cooling system 1200, the fans 1216, 1226, 1236, 1246 are provided in the exhaust air stream rather than intake streams, and this may be preferable (but is not required to practice the system 1200) so that the fan-related heat is not introduced into the system 1200.

Cross-flow, air-to-air heat exchangers are typically less efficient than counter-flow designs in which efficiency is defined as the approach of the temperature of the first airstream to the temperature of the second airstream and vice versa. For example, typical cross-flow heat exchangers may achieve 60 to 70 percent efficiency whereas counter-flow designs may be in the range of 80 to 90 percent efficiency. This lower efficiency of conventional cross-flow heat exchangers is an important design consideration for the cooling system 1200 and its cross-flow heat exchangers 1214, 1224, 1234, 1244 because reducing the temperature of the incoming, ambient air to a pre-cooled, lower temperature acts to lower the wet bulb. This allows the cooling system 1200 to achieve lower output water temperatures. On the other hand, cross-flow, air-to-air heat exchangers are desirable because they are typically more compact than counter-flow heat exchangers designed for the same exchanging air flow volumes. Cross-flow, air-to-air heat exchangers are also typically easier to manufacture and require less fan power.

Figure 13:
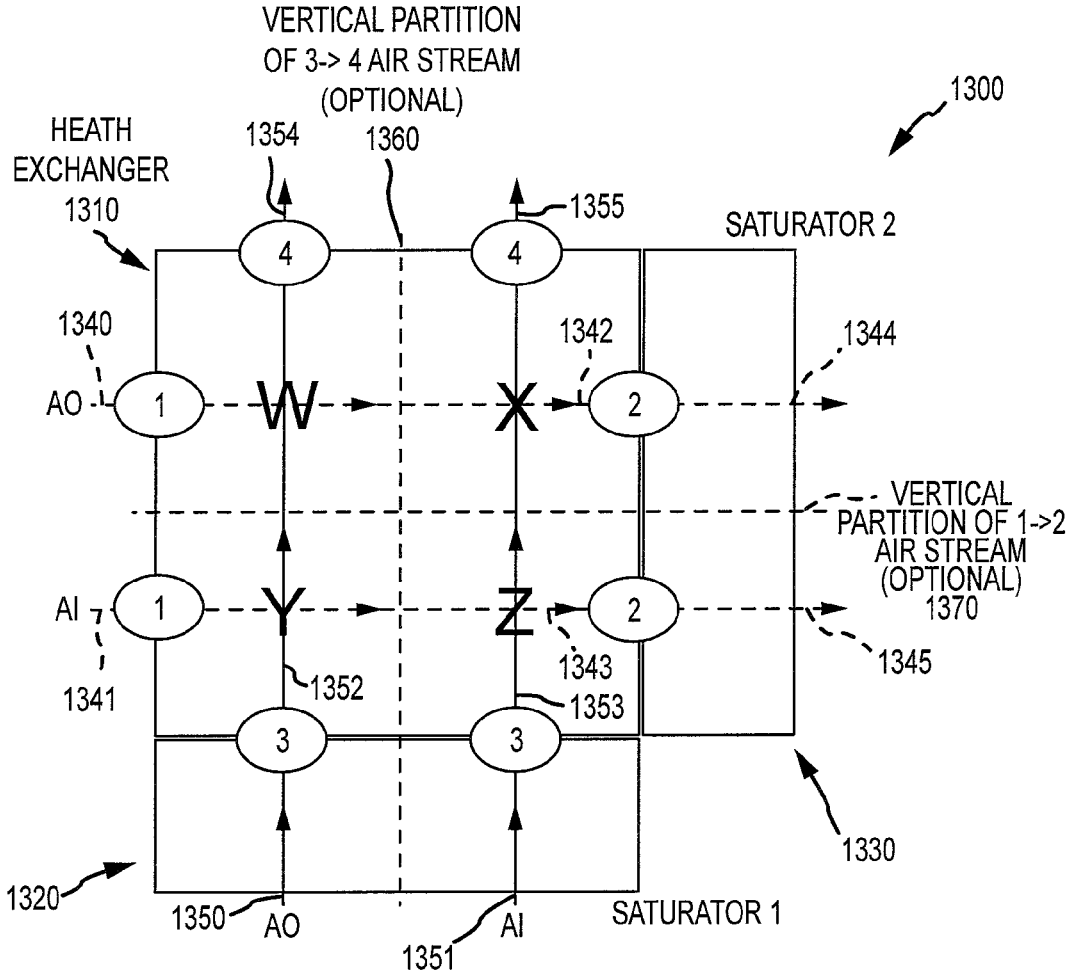
FIG. 13 is a partial top view of a cooling system that integrates four chillers or subunits and that has been modified (relative to the design of the system of FIG. 12) to include vertical partitions to compartmentalize or partition both the airstreams and the water streams.

With the above considerations in mind, the inventor determined that it is useful and beneficial to compartmentalize or partition the air and water streams in the multiple subunit/chiller design. Compartmentalization or partitioning as taught herein increases the effective efficiency of the completely cross-flow heat exchangers in a cooling system (such as in system 1200 of FIG. 12). FIG. 13 is a partial top view of a cooling system 1300 that may integrate four chillers or subunits and that has been built to include vertical partitions 1360 and 1370 to compartmentalize or partition both the airstreams and the water streams. In FIG. 13, a single heat exchanger 1310 is shown but three more units likely would be provided in the system 1300 as is shown for system 1200 with the heat exchangers placed in the corner of a square or rectangular design to provide straight airflow paths. Also, the cooling system 1300 is shown to include first and second saturators 1320, 1330 along two of the sides of the heat exchanger 1310, but the system 1300 typically would include two more saturators as shown for system 1200, with the saturators sandwiched between pairs of heat exchangers to support straight paths for air flow in the system 1300.

The cooling system 1300 provides an example of a simple bifurcation of the airstreams (which may be provided in the system 1200). The airstreams are separated into an inner airstream (AI) and an outer airstream (AO) passing through each component of the cooling system 1300. Particularly, the ambient air into the heat exchanger 1310 is divided up into an outer stream 1340 and an inner stream 1341, and each of these streams flows straight through the heat exchanger 1310 (e.g., in a channel defined by partitioning spacers between the parallel plates/sheets). After being pre-cooled, the airstreams 1342, 1343 are passed into a saturator 1330 until the cool return air is passed out at 1344, 1345 (such as to another heat exchanger as pre-cooled air in). In saturator 1320, pre-cooled air is provided (e.g., from another heat exchanger (not shown but understood from system 1200 of FIG. 12)) in outer stream 1350 and inner stream 1351. The streams are provided as cool return air 1352, 1353 to the heat exchanger 1310 in a cross-flow manner relative to streams 1340, 1341, and then the hot air is exhausted (such as via a fan(s)) from the cooling system 1300 as shown at 1354, 1355.

The separation of the airstreams into inner and outer streams as shown at 1340, 1341, 1350, 1351 may be done with a physical barrier as shown with vertical partitions 1360, 1370. In other cases, though, the partitioning is a conceptual bifurcation based on the fact that the air will not significantly mix laterally in the heat exchangers and saturators. The concept in play here is that in the heat exchanger 1310, inner airstream (e.g., stream 1341 or AI as it passed from Point 1 to Point 2 of its path to become pre-cooled air 1343 fed to saturator 1330) will be giving up heat in Quadrants Y and Z (of the heat exchanger 1310) to the airstreams 1352, 1353 that have just come out of the first saturator 1320. In the heat exchanger 1310, the outer airstream (e.g., stream 1340 or AO as it passed from Point 1 to Point 2 of its path to become pre-cooled air 1342) will be giving up heat in Quadrants W and X (of the heat exchanger 1310) to the airstreams 1352, 1353 that have already taken up some heat from its passage through Quadrants Y and Z (of the heat exchanger 1310).

The result is that the temperatures of the inner air streams (AI) will be lower than those of the outer air streams (AO). In other words, the efficiency of exchange in each quadrant is the same, but the entering air temperatures are such that the entering inner stream (AI) will experience a greater temperature drop than the entering outer stream (AO). Such non-uniformity of air temperatures exiting a plate-based heat exchanger 1310 can be shown empirically.

Figure 14:
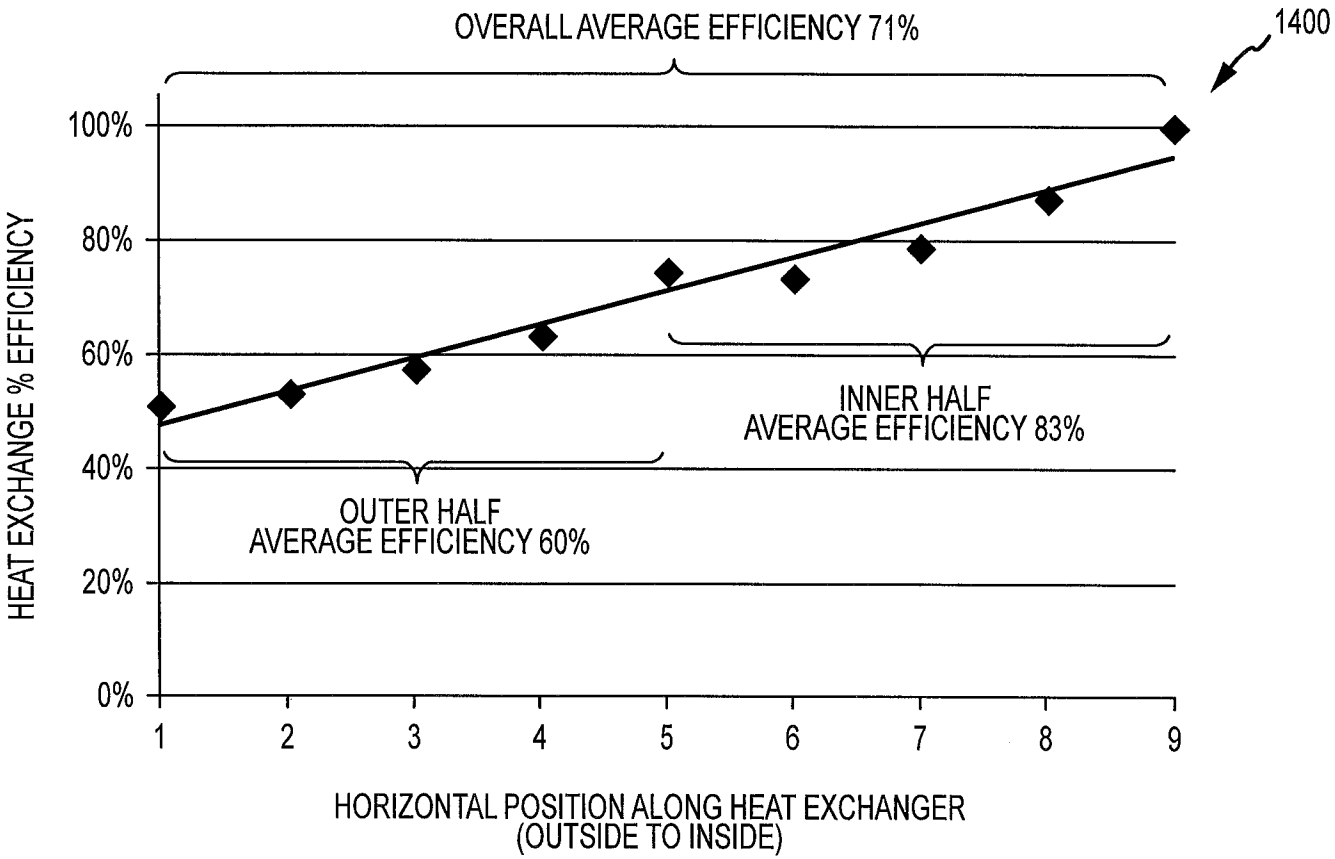
FIG. 14 is a graph showing heat exchange efficiency (on Y-axis) relative to horizontal position along a heat exchanger from outside to inside positions (on X-axis)

FIG. 14 provides a graph 1400 showing heat exchange efficiency (in percentage units on Y-axis) relative to horizontal position along a heat exchanger from outside to inside positions (on X-axis). Non-uniform efficiency of heat exchange was observed in a heat exchanger of a prototype sub-wet bulb evaporative chiller system. Efficiency was calculated for incoming airstreams (paths of airstreams 1340, 1341 shown in FIG. 13) at horizontal positions at the heat exchanger exit (for outside to inside) as the percent approach to the average temperature of air entering the heat exchanger 1310 in the cross-flow direction (paths of airstreams 1350, 1351 shown in FIG. 13). The sub-wet bulb evaporative chiller design (such as in system 1300 of FIG. 13) takes advantage of this non-uniformity in that the average efficiency of the inner half of the heat exchanger is significantly higher than the overall average (e.g., 83 percent versus 71 percent, respectfully, as shown for the sample data in the graph 1400 of FIG. 14). Efficiency is based on the approach factor of the temperature of the first airstream to the temperature of the second airstream. This provides opportunities through compartmentalization to utilize higher efficiencies than typically achieved in cross-flow heat exchangers.

Similarly, bifurcation or partitioning may be provided for the water flow through the saturators such as saturators 1320, 1330 of the system 1300. Water flowing down through the outer half of each saturator will interact only with air in the outer stream (AO), and water flowing down through the inner half of each saturator will interact only with the air in the inner stream (AI) of FIG. 13. Because the inner airstream is colder due to the greater heat transfer efficiency (as described above), the inner water stream will be able to reach lower temperatures. Ideally, warm water from the load can be passed first through the outer portions of the saturators and then passed through the inner portions. This will achieve lower temperatures than if the water were only exposed to a single, bulk airstream coming out of the heat exchanger.

Thus, the cooling system designs shown herein take advantage of the non-uniformity of efficiency in cross-flow, plate-based, air-to-air heat exchangers to achieve lower water temperatures in the cooling systems. There will also be a positive feedback effect because the water in the inner portions of the saturators will be colder. As a result, the air entering the heat exchanger adjacent to the inner portion of the saturator, e.g., airstream 1353 (or AI) at Point 3 in FIG. 13, will be colder than the average temperature of the air exiting the first saturator 1320. This causes the airstream (e.g., airstream 1341) passing through Quadrants Y and Z of the heat exchanger 1310 to reach lower temperatures, which reduces the wet bulb temperature of air entering the inner portion of the second saturator 1330. This further reduces the water temperature in the inner portion of the second saturator 1330. Also, as discussed previously, the vertical gradient will also be in effect throughout the components of the cooling system 1300 to further enhance overall cooling efficiencies.

Bifurcation or partitioning of the saturators into inner and outer portions may be achieved in a number of ways, with the following techniques being one useful but not limiting example. Physical separation within the saturator can be provided by addition of a vertical partition in parallel to the air flow. Alternatively, in the case where Munter's honeycomb or a similar material is used in the saturator as packing/pads, the material itself provides separation of water flow into discreet vertical channels. Even with no vertical partitions, lateral mixing of the water flowing under gravity might be minimal. It then becomes useful to separate the water input at the top (e.g., with separate "distributors") and the collection at the bottom (e.g., with separate "sumps").

Figure 15A:
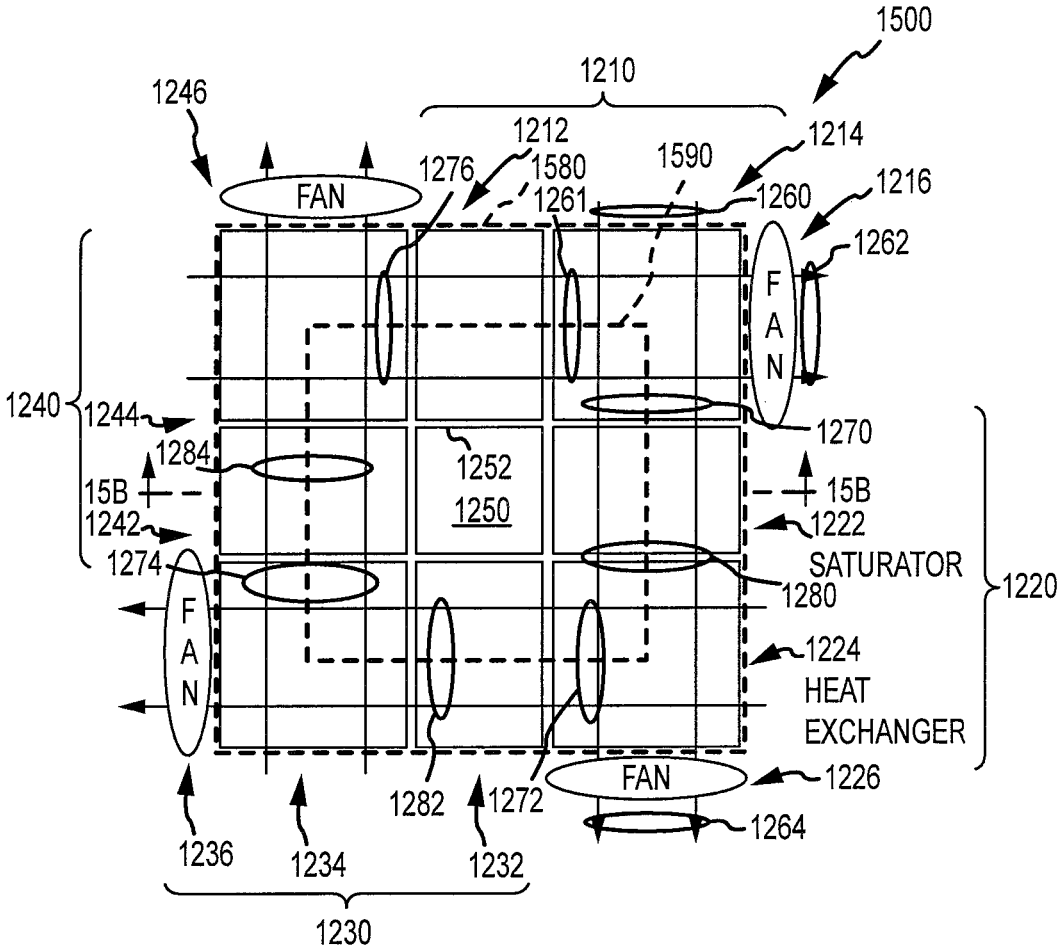
FIGS. 15A and 15B illustrate a top view (in schematic fashion) and a cross sectional view of a cooling system similar to that shown in FIG. 13 that integrates four subunits or chillers and that further provides partitioning of the water flowing within the cooling system.
Figure 15B:
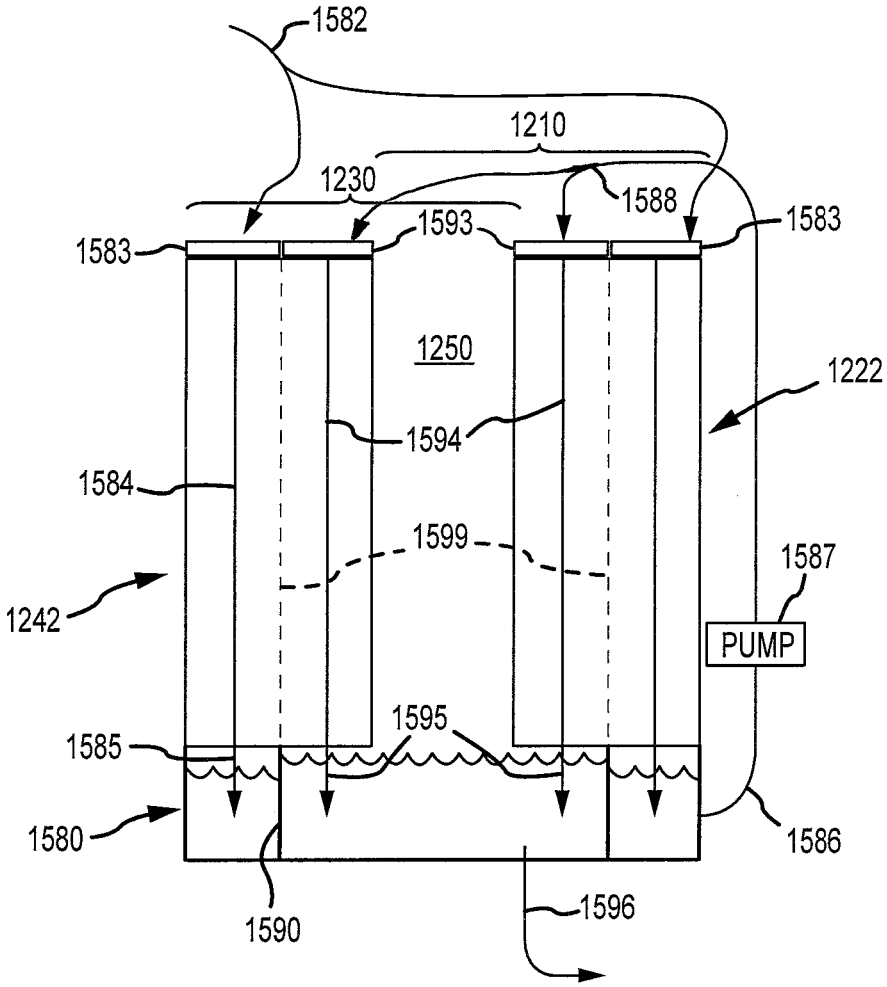

FIGS. 15A and 15B illustrate a top view (in schematic fashion) and a cross sectional view of a cooling system 1500 similar to that shown in FIG. 13 that integrates four subunits or chillers, and like components from system 1300 of FIG. 13 are given like numbers in the system 1500 (and description of each component is not repeated but will be understood from the description of FIG. 13 above).

The cooling system 1500 differs from system 1300 in that partitioning of the water flowing within the cooling system 1500 is used to further enhance cooling efficiencies. FIG. 15A shows exemplary locations for an outer sump 1580 (defined by sidewalls extending about the periphery of the system 1500 and outer walls of the inner sump 1590) and an inner sump 1590. This is a sump-within-a-sump design. The outer sump 1580 is positioned so as to capture the water draining from the outer halves or portions of the four saturators 1212, 1222, 1232, 1242 of the cooling system 1500. The inner sump 1590 is positioned and adapted to capture the water draining from the inner halves or portions of the four saturators 1212, 1222, 1232, 1242.

To this end, the cooling system 1500 may include vertical partitions 1599 extending the height and centrally within the saturators 1212, 1222, 1232, 1242 as shown in FIG. 15B. In use, water 1582 from a load is pumped or directed into water distributors 1583 that direct the water 1582 to flow (in a relatively uniform and horizontally distributed manner) as shown at 1584 in the outer portions or halves of the saturators 1212, 1222, 1232, 1242. After cooling in these saturators, the water is drained as shown at 1585 into the outer sump 1580. Water 1586 is then drawn by a pump(s) 1587 from the outer sump 1580 and lifted/pumped into water distributors 1593 provided at the top of the cooling system 1500. The water distributors 1593 direct water 1588 to flow (in a relatively uniform and horizontally distributed manner) into the inner halves or portions of the saturators 1212, 1222, 1232, 1242 as shown at 1594 (with the inner halves defined, optionally, by the vertical partitions 1599). After being cooled in the saturators, the water 1595 drains under gravity into the inner sump 1590. The water 1596 may then be pumped or drained to a load (e.g., to an air-to-water heat exchanger as shown in FIG. 1).

The outer and inner distributors 1583, 1593 are typically plumbed separately. This allows, for example, water 1582 from the load to first be pumped to the outer water distributor(s) 1583. The water 1584 then drains down through the outer halves, portions, or compartments of the saturators

1210, 1220, 1230, 1240 and into the outer sump 1580 as shown at 1585. A pump 1587 in or out of the outer sump 1580 then pumps the water 1586 to the inner water distributor(s) 1593, where the water 1588 drains down through the inner halves of the saturators 1210, 1220, 1230, 1240 as shown at 1594 until it drains into the inner sump 1590 where it is collected. The chilled water 1596 from the inner sump 1590 is then pumped to the point of use for cooling of a building or a process system.

It should be understood that it would be possible to divide the air and water streams into more than two compartments such as with additional partitions/dividers and divisions of the distributors and sumps. Division, for example, into three or more compartments could further enhance the efficiency and decrease potential water temperatures. However, each additional division adds complexity and another pumping step. Further, it should be understood that the compartmentalization of flows may be done with a single subunit (as in the unit 900 of FIGS. 9A and 9B) as well as in a system combining two or more integrated subunits or chillers (such as the systems 1000 and 1100 of FIGS. 10 and 11). However, in some preferred implementations, a cooling system (such as system 1200 of FIG. 12) with four integrated subunits or chillers is desirable and is ideally suited to the compartmentalization concept. Further, compartmentalization may be done with partially counter-flow heat exchangers as well as with the cross-flow devices shown herein.

A recirculation mode of operation may be used with the cooling systems in which there is no external load but water continues to pass through the saturators in order to reduce water temperatures between calls or demands for cooling. This may be achieved, for example but not limitation, by placing a notch in the partition between the inner and outer sumps. In recirculation mode, when the building or other load is not calling for cooling, the load loop, which removes water from the inner sump passes it through the building and returns it to the outer water distributors, is turned off. All of the fans would remain on, though perhaps at reduced air velocity to enhance heat exchange efficiency, and the pump(s) in the outer sump continue to operate and deliver water from the outer sump to the inner water distributor, thereby continuing to cool this water. As the inner sump overfills, it would drain through the notch provided to the outer sump, thereby creating a flow loop. Although the outer portions of the saturators would not have the bulk water stream flowing through them, they typically would be kept minimally wet to continue to cool the outer airstreams. This can be achieved by stopping the recirculation mode before all of the residual moisture is evaporated, by providing a small bleed or short pulses of water to the outer water distributors (e.g., enough to keep the outer saturators wet), and/or by running the load loop pump briefly periodically (e.g., enough to wet the outer saturators).

As a brief summary, the above description teaches two improvements to previously known sub-wet bulb evaporative chillers, e.g., chillers based on use of horizontal plate heat exchangers: (1) integration of multiple subunits or chillers into a single cooling system and (2) compartmentalization of air and water flows through the cooling system. These two improvements provide a number of advantages over prior cooling systems. First, completely straight flow paths for airstreams may be provided, which reduces the required fan power. Second, straight flow paths also improve the uniformity of airflow through the heat exchangers and saturators, which increases the average efficiency of heat exchange and evaporation. Third, the integrated design is space efficient, which provides a large amount of air/water contact area and large heat exchangers in a relatively small footprint. Fourth, large heat exchanger and saturator surfaces allow lower airflow velocities to be used, thereby increasing the efficiency of heat exchange and evaporation. Fifth, partitioning of airstreams in the cross-flow, air-to-air heat exchangers takes advantage of non-uniform temperature output to achieve effectively higher heat exchange efficiency and, therefore, colder output water. Sixth, the cross-flow heat exchangers are space efficient, require relatively little fan power to move air through, and can be readily manufactured. Seventh, bifurcation of water streams essentially doubles the vertical water flow path within a compact unit, and use of three or more compartments or vertical flow channels may be used to further increase the water path length in the saturators. Eighth, the vertical gradient effect within the cooling system and each of its subunits/chillers facilitates achieving lower water temperatures.

Figure 16:
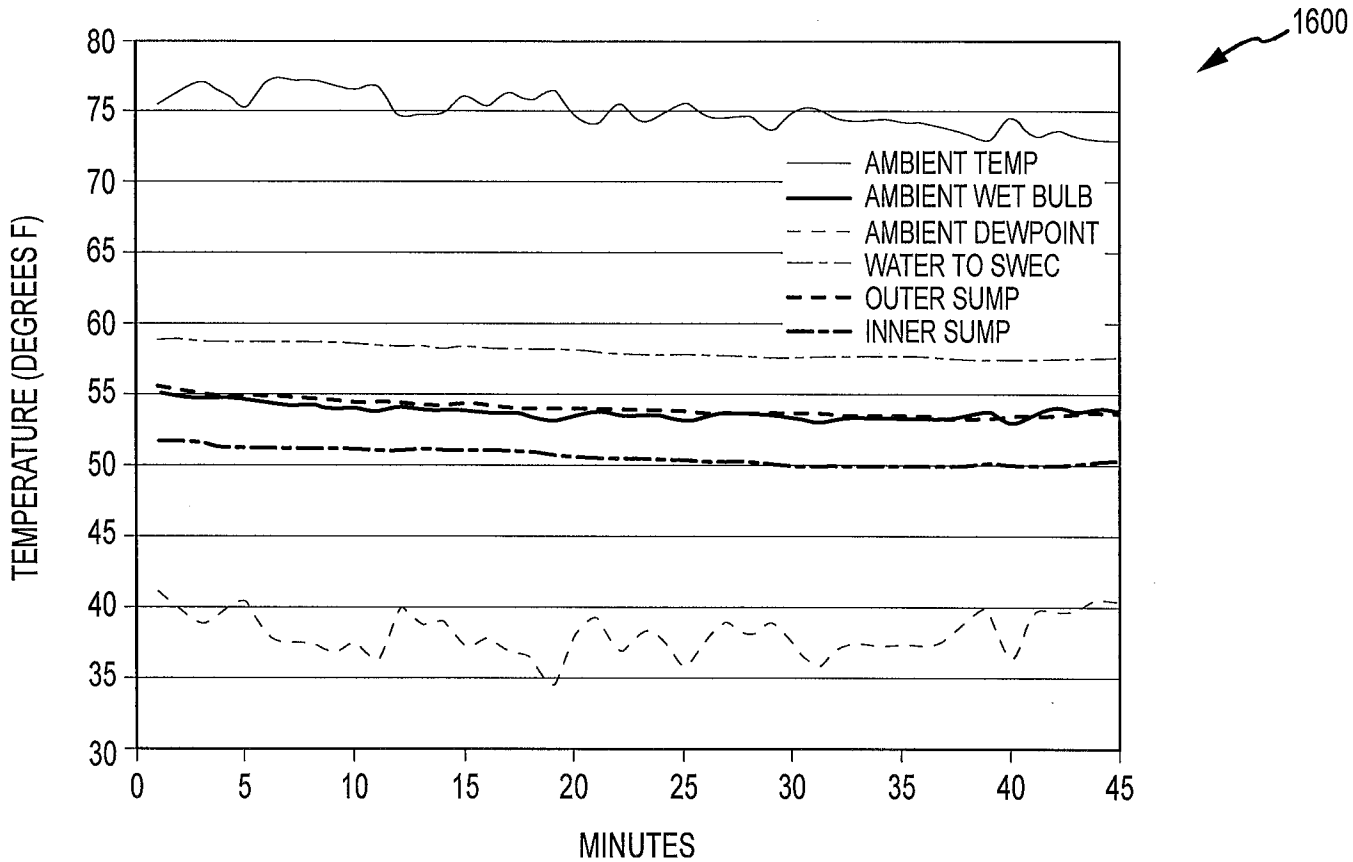
FIG. 16 is a graph showing temperature values measured over a sample period of operation of a cooling system (e.g., the system of FIG. 15).

At least some of these advantages can readily be seen or understood with review of sample data of prototypes of systems built according to the teaching provided herein. For example, FIG. 16 provides a graph 1600 of temperatures (Y-axis) over time (X-axis) showing sample data for 45 minutes of operation of a prototype cooling system integrating four sub-wet bulb evaporative chillers as shown with system 1200 of FIG. 12. Over this sample 45 minute period, the ambient temperature averaged 75.0° F., the ambient wet bulb temperature averaged 53.8° F., and the ambient dew point averaged 38.2° F. The temperature of the incoming water from the load averaged 58.1° F., the water in the outer sump averaged 54.1° F., and the water in the inner sump (cooling system output water) averaged 50.7° F. Thus, output water was 3.1° F. below the ambient wet bulb, and the second water pass (within the inner air stream) dropped the temperature an additional 3.4° F. below the temperature reached after the first pass (within the outer airstream). During this sample 45 minute period, the cooling system averaged heat rejection of 13,600 BTU/hr and demonstrated an EER of 46.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A cooling system, comprising:

a first evaporative chiller; and a second evaporative chiller;

wherein the first and second evaporative chillers are integrated to define a plurality of airstream flow paths extending through at least two of the evaporative chillers, wherein a first ambient air stream is moved through a heat exchanger of the first evaporative chiller and directed through a saturator of the second evaporative chiller; and wherein the first ambient air stream exhausted from the saturator of the second evaporative chiller is directed through a heat exchanger of the second evaporative chiller prior to being exhausted from the cooling system.

2. The cooling system of claim 1, wherein each of the airstream flow paths are linear and wherein the heat exchangers are each configured as a cross-flow, horizontal-plate, air-to-air heat exchanger.

3. The cooling system of claim 1, wherein the first and second evaporative water chillers each comprise a sub-wet bulb evaporative chiller.

4. The cooling system of claim 3, wherein the first and second evaporative water chillers each include a saturator with a liquid inlet and a liquid outlet, wherein water to be cooled enters the saturator through the liquid inlet and drains by gravity through the saturator and exits through the liquid outlet.

5. The cooling system of claim 1, wherein a second ambient air stream is moved through a heat exchanger of the second evaporative chiller and directed through a saturator of a third evaporative chiller and wherein the second ambient air stream exhausted from the saturator of the third evaporative chiller is directed through a heat exchanger of the third evaporative chiller prior to being exhausted from the cooling system.

6. A cooling system, comprising:

a first evaporative chiller;

a second evaporative chiller, wherein the first and second evaporative chillers are integrated to define a plurality of airstream flow paths extending through at least two of the evaporative chillers, wherein a first ambient air stream is moved through a heat exchanger of the first evaporative chiller and directed through a saturator of the second evaporative chiller, wherein the first ambient air stream exhausted from the saturator of the second evaporative chiller is directed through a heat exchanger of the second evaporative chiller prior to being exhausted from the cooling system, wherein the first and second evaporative water chillers each comprise a sub-wet bulb evaporative chiller, wherein the first and second evaporative water chillers each include a saturator with a liquid inlet and a liquid outlet, and wherein water to be cooled enters the saturator through the liquid inlet and drains by gravity through the saturator and exits through the liquid outlet; and an outer sump and an inner sump, wherein the water to be cooled is first distributed to flow in an outer portion of each of the saturators and is drained into an outer sump, and wherein water is pumped from the outer sump to be second distributed to flow in an inner portion of each of the saturators and is drained into an inner sump.

7. A cooling system, comprising:

a first evaporative chiller; and a second evaporative chiller, wherein the first and second evaporative chillers are integrated to define a plurality of airstream flow paths extending through at least two of the evaporative chillers, wherein a first ambient air stream is moved through a heat exchanger of the first evaporative chiller and directed through a saturator of the second evaporative chiller, wherein the first ambient air stream exhausted from the saturator of the second evaporative chiller is directed through a heat exchanger of the second evaporative chiller prior to being exhausted from the cooling system, wherein a second ambient air stream is moved through a heat exchanger of the second evaporative chiller and directed through a saturator of a third evaporative chiller, wherein the second ambient air stream exhausted from the saturator of the third evaporative chiller is directed through a heat exchanger of the third evaporative chiller prior to being exhausted from the cooling system, wherein a third ambient air stream is moved through a heat exchanger of the third evaporative chiller and directed through a saturator of a fourth evaporative chiller, and wherein the third ambient air stream exhausted from the saturator of the fourth evaporative chiller is directed through a heat exchanger of the fourth evaporative chiller prior to being exhausted from the cooling system.

8. The cooling system of claim 7, wherein a fourth ambient air stream is moved through the heat exchanger of the fourth evaporative chiller and directed through a saturator of the first evaporative chiller and wherein the fourth ambient air stream exhausted from the saturator of the first evaporative chiller is directed through the heat exchanger of the first evaporative chiller prior to being exhausted from the cooling system.

9. A cooling unit, comprising:

at least two evaporative subunits each comprising:

a saturator;

a horizontal plate, air-to-air heat exchanger; and a fan for drawing a volume of air first through the saturator and second through the heat exchanger, wherein incoming airstreams used to evaporate water from water streams flowing through the saturators via gravity are first cooled indirectly in the heat exchangers using the volume of air drawn through the saturators by the fan and second directed to flow into an inlet of one of the saturators provided in an adjacent one of the evaporative subunits.

10. The cooling unit of claim 9, wherein airstream paths in the cooling unit are configured such that the heat exchangers are fully cross-flow.

11. The cooling unit of claim 9, wherein the airstream paths are linear through adjacent pairs of the saturators and the heat exchangers.

12. A cooling unit, comprising:

at least two evaporative subunits each comprising:

a saturator;

a horizontal plate, air-to-air heat exchanger; and a fan for drawing a volume of air first through the saturator and second through the heat exchanger, wherein incoming airstreams used to evaporate water from water streams flowing through the saturators via gravity are first cooled indirectly in the heat exchangers using the volume of air drawn through the saturators by the fan and second directed to flow into an inlet of one of the saturators provided in an adjacent one of the evaporative subunits, wherein the cooling unit comprises four of the evaporative subunits, and wherein the saturators are each sandwiched between a pair of the heat exchangers, whereby the incoming airstreams each first pass through one of the heat exchangers, second pass through one of the saturators, and third pass through another one of the heat exchangers.

13. A cooling unit, comprising:

at least two evaporative subunits each comprising:

a saturator;

a horizontal plate, air-to-air heat exchanger; and a fan for drawing a volume of air first through the saturator and second through the heat exchanger, wherein incoming airstreams used to evaporate water from water streams flowing through the saturators via gravity are first cooled indirectly in the heat exchangers using the volume of air drawn through the saturators by the fan and second directed to flow into an inlet of one of the saturators provided in an adjacent one of the evaporative subunits; and an outer sump and an inner sump, wherein water to be cooled is first directed to flow into an inlet of an outer, vertical compartment of the saturators and is drained into an outer sump, and wherein the water is pumped from the outer sump and second directed to flow into an inlet of an inner, vertical compartment of the saturators and is drained into an inner sump.

14. The chiller of claim 13, wherein the water in the inner sump is at a temperature below the wet bulb temperature of the ambient air.

15. An evaporative cooling system, comprising:

first, second, third, and fourth chillers arranged to provide linear flow paths for airstreams passing through the chillers, wherein each of the chillers comprises a saturator and an air-to-air heat exchanger generating a stream of pre-cooled air at an air inlet to the saturator of an adjacent one of the chillers, wherein the pre-cooled air stream is generated by cooling ambient air to temperatures below ambient air temperature by transferring heat, in the air-to-air heat exchangers of each of the first, second, third, and fourth chillers, from the ambient air to air exiting the saturator of the corresponding one of the first, second, third, or fourth chillers, wherein the pre-cooled air temperatures range from a higher temperature proximate to a top of the saturator and a lower temperature proximate to a bottom of the saturator, and wherein each of the saturators is partitioned into at least an outer flow channel and an inner flow channel more proximate a center of the cooling system, the cooling system further comprising a water circulation system pumping water exiting the outer flow channels of the saturators and collected in an outer sump to an inlet to the inner flow channels for flowing via gravity through the inner flow channels and for collection in an inner sump.

16. The system of claim 15, wherein the first, second, third, and fourth chillers are arranged to have a square cross sectional shape and to position each of the saturators between an air outlet of one of the heat exchangers and an air inlet of another one of the heat exchangers.

17. The system of claim 15, wherein the heat exchangers comprise a plurality of horizontal, spaced-apart, and parallel plates defining a plurality of passageways for the airstreams.

18. An evaporative cooling system, comprising:

first, second, third, and fourth chillers arranged to provide linear flow paths for airstreams passing through the chillers, wherein each of the chillers comprises a saturator and an air-to-air heat exchanger generating a stream of pre-cooled air at an air inlet to the saturator of an adjacent one of the chillers, wherein the pre-cooled air stream is generated by cooling ambient air to temperatures below ambient air temperature by transferring heat, in the air-to-air heat exchangers of each of the first, second, third, and fourth chillers, from the ambient air to air exiting the saturator of the corresponding one of the first, second, third, or fourth chillers, wherein the pre-cooled air temperatures range from a higher temperature proximate to a top of the saturator and a lower temperature proximate to a bottom of the saturator, and wherein the first, second, third, and fourth chillers are interconnected to cause the airstreams to flow through the heat exchangers such that incoming ambient air flows in a first direction while cool return air from one of the saturators of another of the chillers flows in a second direction that is substantially orthogonal to the first direction.

* * * * *

UNITED STATES PATENT AND TRADEMARK OFFICE

CERTIFICATE OF CORRECTION

PATENT NO. : 9,207,018 B2
APPLICATION NO. : 13/916677
DATED : April 14, 2015
INVENTOR(S) : Eric Edward Jarvis It is certified that error appears in the above-identified patent and that said Letters Patent is hereby corrected as shown below:

In the specification

Column 3, line 17, delete "NC" and insert therefor --A/C--.

Signed and Sealed this
Fifteenth Day of March, 2016

Michelle K. Lee

Michelle K. Lee
*Director of the United States Patent and Trademark Office*